US006179401B1

(12) United States Patent
Stephens, Jr. et al.

(10) Patent No.: US 6,179,401 B1
(45) **Date of Patent: *Jan. 30, 2001**

(54) MULTI-COMPONENT INSTALLATION FEEDBACK SYSTEM FOR REPLACEMENT PRINT CARTRIDGES, VALVE HOLDERS, AND SERVICE STATION CASSETTES FOR ON BOARD INK DELIVERY SYSTEMS REPLENISHMENT

(75) Inventors: Ronald D. Stephens, Jr., Escondido; Don Boutin, Poway, both of CA (US); Manel Martinez, Barcelona (ES); Brian Canfield, Encinitas; Amy Van Liew, Oceanside, both of CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/034,975

(22) Filed: Mar. 4, 1998

Related U.S. Application Data

(63) Continuation-in-part of application No. 08/811,406, filed on Mar. 4, 1997, now Pat. No. 6,076,913.

(51) Int. Cl.[7] ..... M41J 2/175
(52) U.S. Cl. ..... 347/19; 347/85
(58) Field of Search ..... 347/85, 86, 87, 347/7, 19

(56) References Cited

U.S. PATENT DOCUMENTS 5,751,305 * 5/1998 Hadley ..... 347/19
5,757,390 * 5/1998 Gragg et al. ..... 347/7
5,905,512 * 5/1999 Beauchamp ..... 347/19

* cited by examiner

*Primary Examiner*—N. Le
*Assistant Examiner*—Anh T. N. Vo

(57) ABSTRACT

An inkjet printing system which provides feedback to enable the user to determine whether various replaceable components such as print cartridges, valve holders, and service station cassettes have been installed in proper position. The system includes a printhead carriage and a first sensor feedback device to determine whether a printhead is installed in an operable position on the carriage. The system also includes at least one off-carriage ink supply to which a printhead or printheads on the carriage is/are periodically connected for periodically providing ink to the printheads and a second sensor feedback device to determine whether the replaceable. off-carriage ink supplies are installed in an operable position. At least one replaceable printhead servicing module is also provided positioned to engage one or more printheads when it is moved into a printhead servicing station and a third sensor feedback device which includes a sensor on the carriage is used to read indicia on the servicing module to confirm that the servicing module is installed in an operable position in said servicing station. Separate safety doors provide access to the printhead or printheads, off-carriage ink supply or supplies and servicing module or modules.

7 Claims, 22 Drawing Sheets

FIG. 6
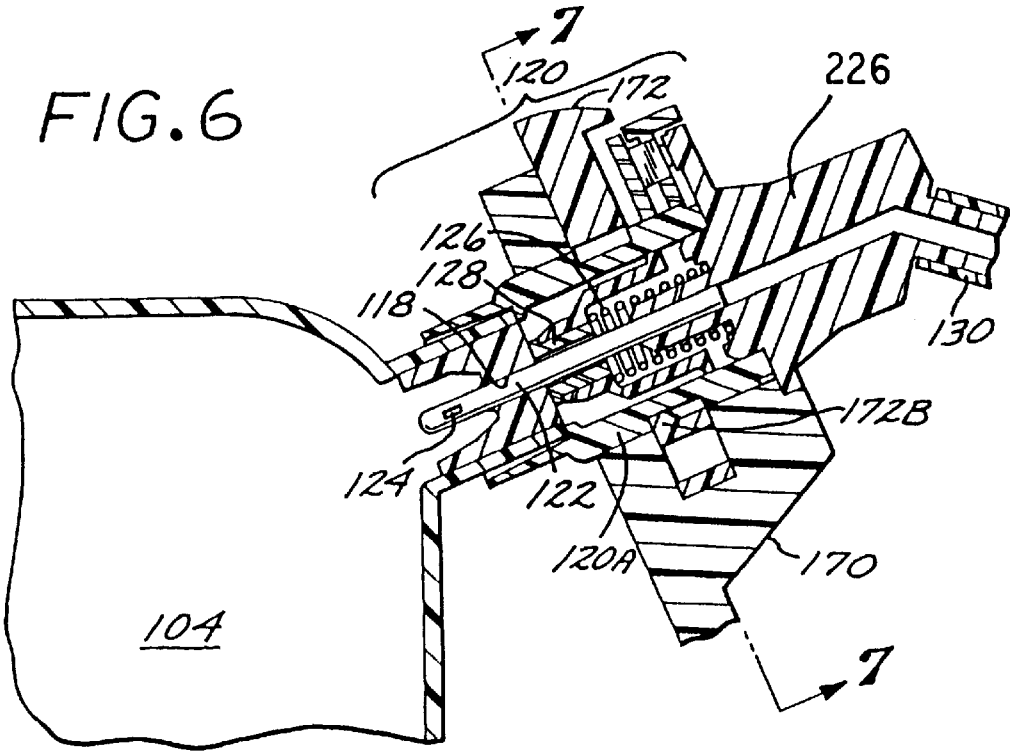
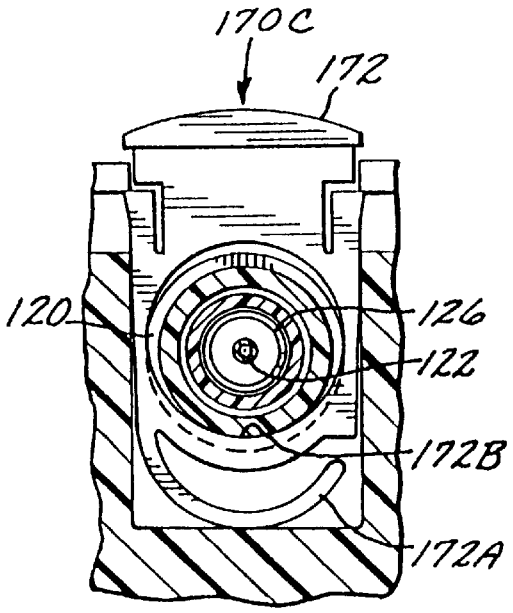
FIG. 7
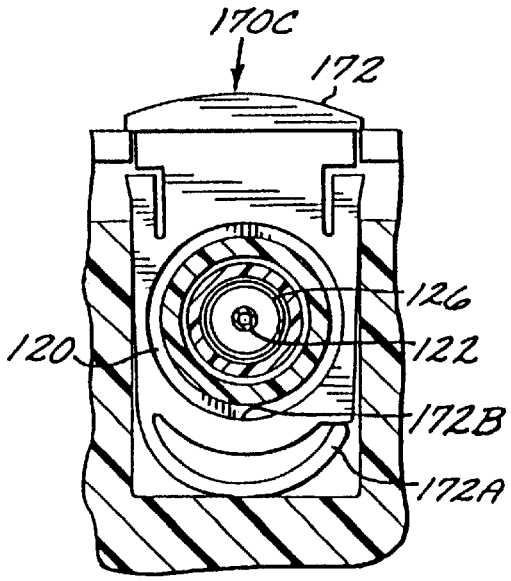
FIG. 8

MULTI-COMPONENT INSTALLATION FEEDBACK SYSTEM FOR REPLACEMENT PRINT CARTRIDGES, VALVE HOLDERS, AND SERVICE STATION CASSETTES FOR ON BOARD INK DELIVERY SYSTEMS REPLENISHMENT

This application is a continuation-in-part of U.S. Ser. No. 08/811,406 filed Mar. 4, 1997 by Garcia et al., entitled OPTICAL ENCODING OF PRINTHEAD SERVICE MODULE, now U.S. Pat. No. 6,076,913 which is incorporated by reference herein.

CROSS-REFERENCE TO RELATED APPLICATIONS

A previously filed co-pending commonly assigned application related to this application is Ser. No. 08/454,975 filed May 31, 1995 by Joseph E. Scheffelin et al. (the "'975 application") entitled CONTINUOUS REFILL OF SPRING BAG RESERVOIR IN AN INK-JET SWATH PRINTER/PLOTTER, which is incorporated herein by reference.

Other more recent co-pending commonly assigned related applications are Ser. No. 08/726,587, entitled INKJET CARTRIDGE FILL PORT ADAPTOR, filed Oct. 7, 1996, by Max S. Gunther, et al.; Ser. No. 08/810,485, entitled INK-JET PRINTING WITH REPLACEABLE SET OF INK-RELATED COMPONENTS etc., filed Mar. 3, 1997, by Rick Becker, et al.; Ser. No. 08/805,859, entitled REPLACEABLE INK SUPPLY MODULE (BAG/BOX/TUBE/VALVE) etc., filed Mar. 3, 1997, by Elizabeth Zapata, et al.; Ser. No. 08/805,860, entitled SPACE EFFICIENT ENCLOSURE SHAPE FOR NESTING TOGETHER A PLURALITY OF REPLACEABLE INK SUPPLY BAGS, filed Mar. 3, 1997, by Erich Coiner, et al.; Ser. No. 08/810,840, entitled PRINTING SYSTEM WITH SINGLE ON/OFF CONTROL VALVE etc., filed Mar. 3, 1997 by Max S. Gunther, et al; Ser. No. 08/805,861, entitled APPARATUS FOR PERIODIC AUTOMATED CONNECTION OF INK SUPPLY VALVES etc., filed Mar. 3, 1997, by Ignacio Olazabal, et al.; Ser. No. 08/806,749, entitled VARIABLE PRESSURE CONTROL FOR INK REPLENISHMENT etc., filed Mar. 3, 1997, by Mark Young, et al.; Ser. No. 08/719,606, entitled CALIBRATION TECHNIQUE FOR MIS-DIRECTED INKJET PRINTHEAD NOZZLES, filed Sep. 25, 1996, by Robert W. Beauchamp et al.; entitled INTERCHANGEABLE FLUID INTERCONNECT ATTACHMENT AND INTERFACE, filed Ser. No. 09/034,721 filed Mar. 4, 1998 by Max S. Gunther; all of which are incorporated herein by reference.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled CONTINUOUS REFILL OF SPRING BAG RESERVOIR IN AN INK-JET SWATH PRINTER/PLOTTER which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printers/plotters has been developed, wherein the on-carriage spring reservoir of the print cartridge is only intermittently connected to the off-carriage reservoir to "take-a-gulp" and is then disconnected from the off-carriage reservoir. No tubing permanently connecting the on-carriage and off-carriage elements is needed. The above-referenced applications describe certain features of this new ink delivery system.

BRIEF SUMMARY OF THE INVENTION

This invention optimizes the performance of this new off-carriage, take-a-gulp ink delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replenishment. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

The invention provides an overall multi-component installation feedback system for replacement print cartridges, valve holders and service station cassettes for an on-carriage ink delivery system replenishment.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6, showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
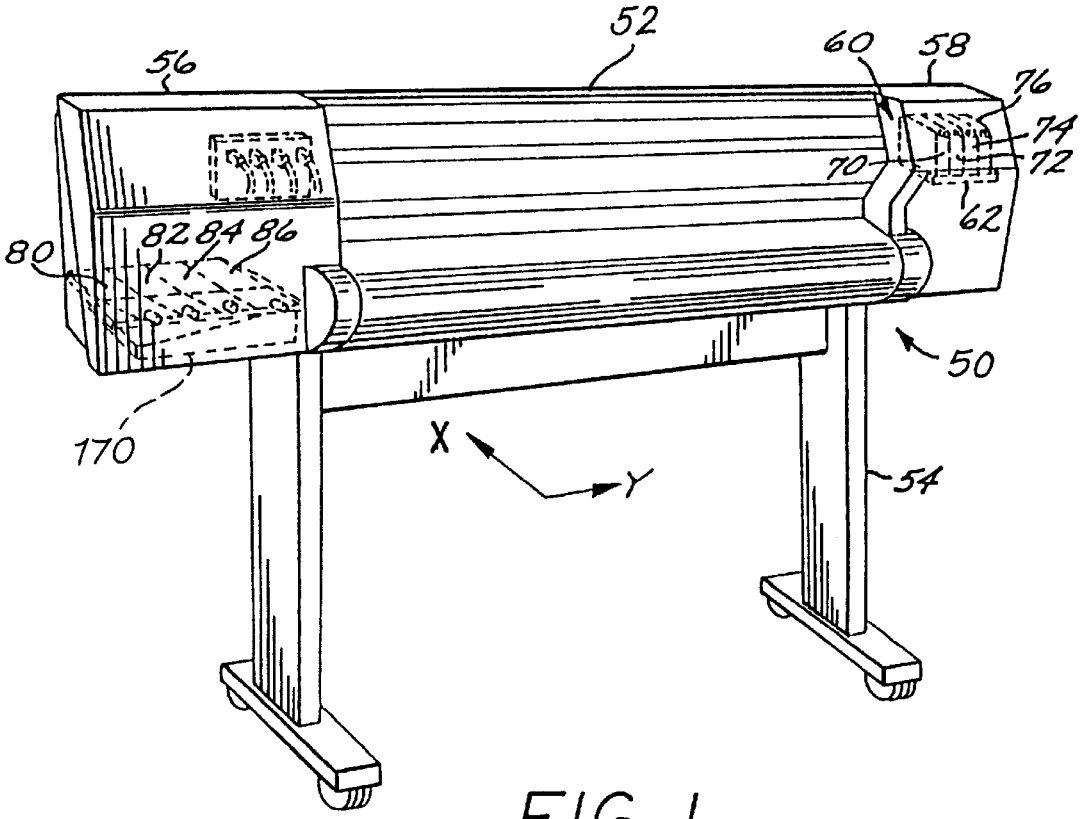
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 58. A print medium such as paper is positioned along a vertical or media axis by a media axis drive mechanism (not shown). As is common in the art, the media drive axis is denoted as the 'x' axis and the carriage scan axis is denoted as the 'y' axis.

Figure 3:
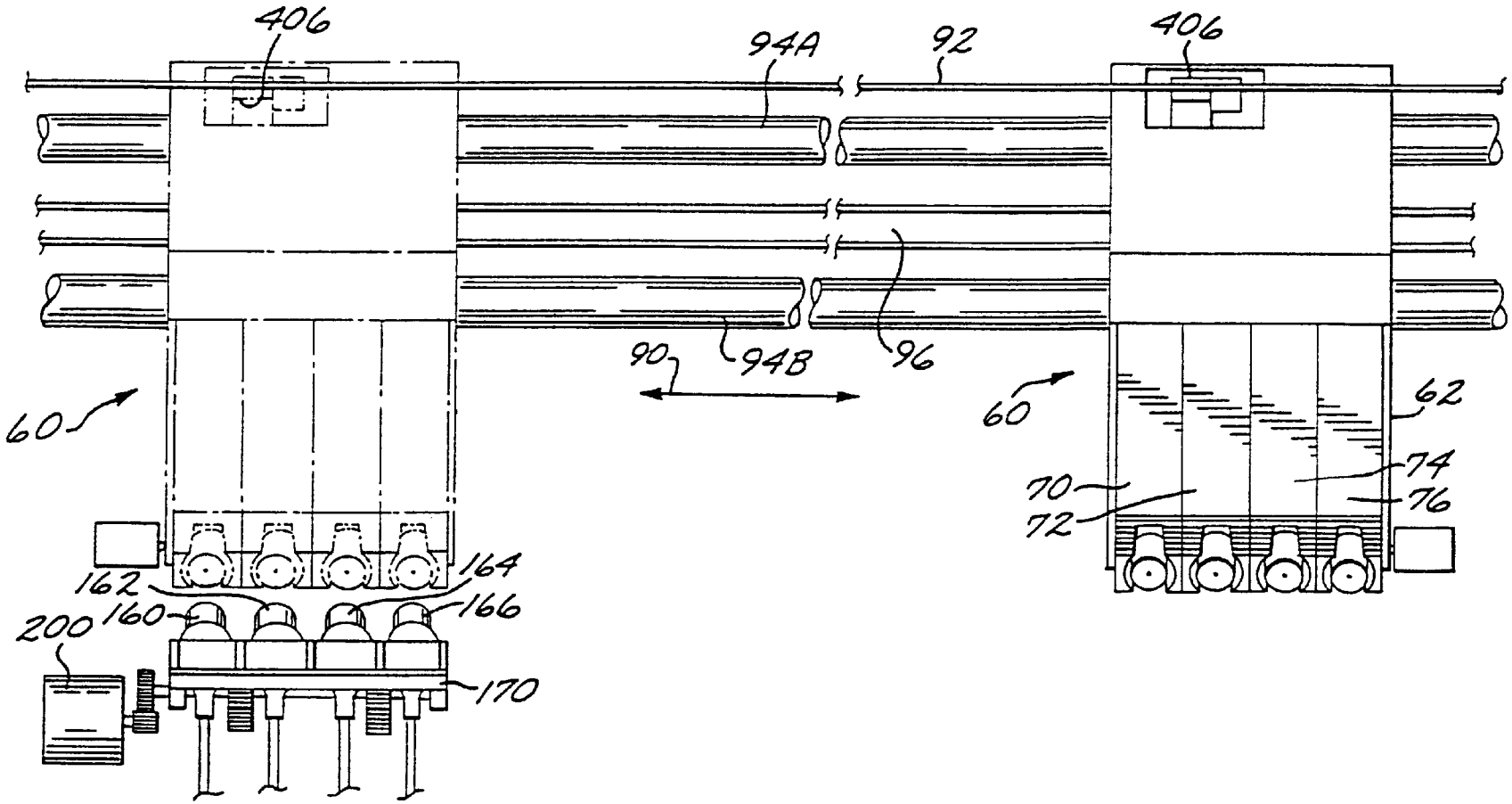
FIG. 3 is a top view showing the printer carriage and refill station.
Figure 4:
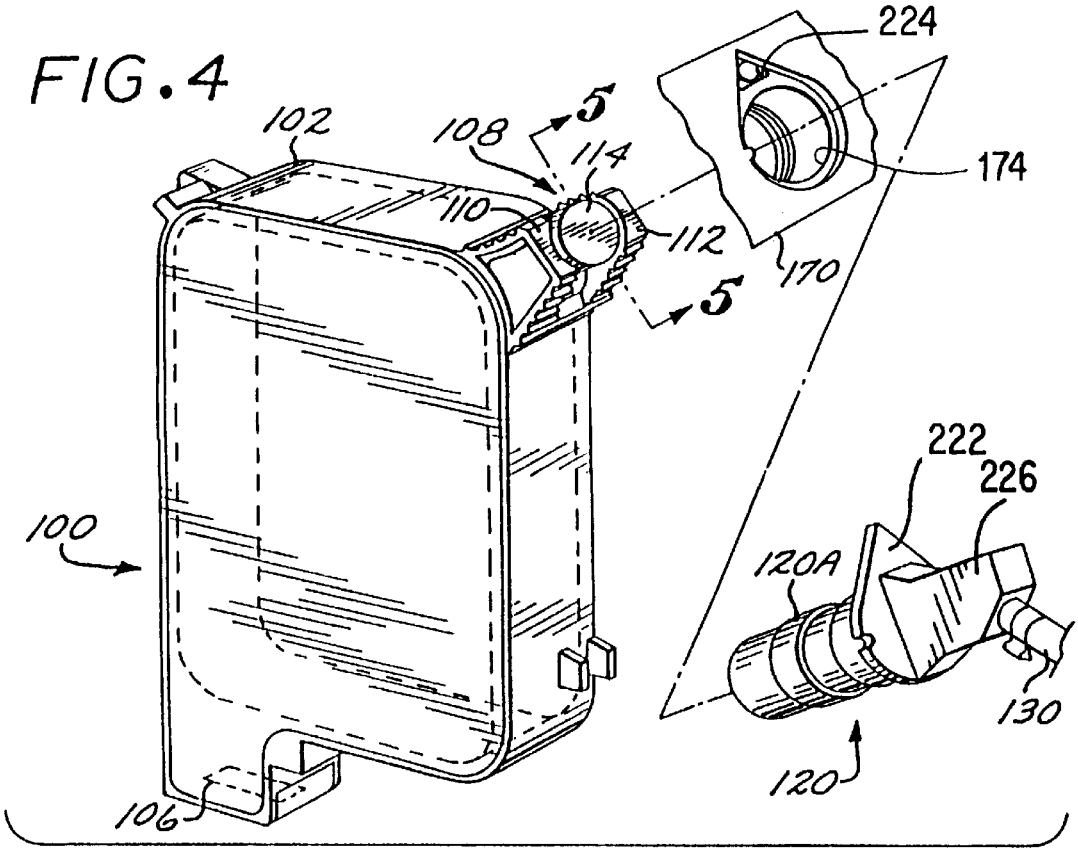
FIG. 4 is an isometric view of an ink-jet print cartridge usable in the system of FIG. 1, with a refill platform housing portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70,72,74 and 76 that store ink of different colors, e.g., black, yellow, magenta and cyan ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear slider rod 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending application Ser. No. 08/805,860, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left cover 58) and the valves attach to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 7076 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
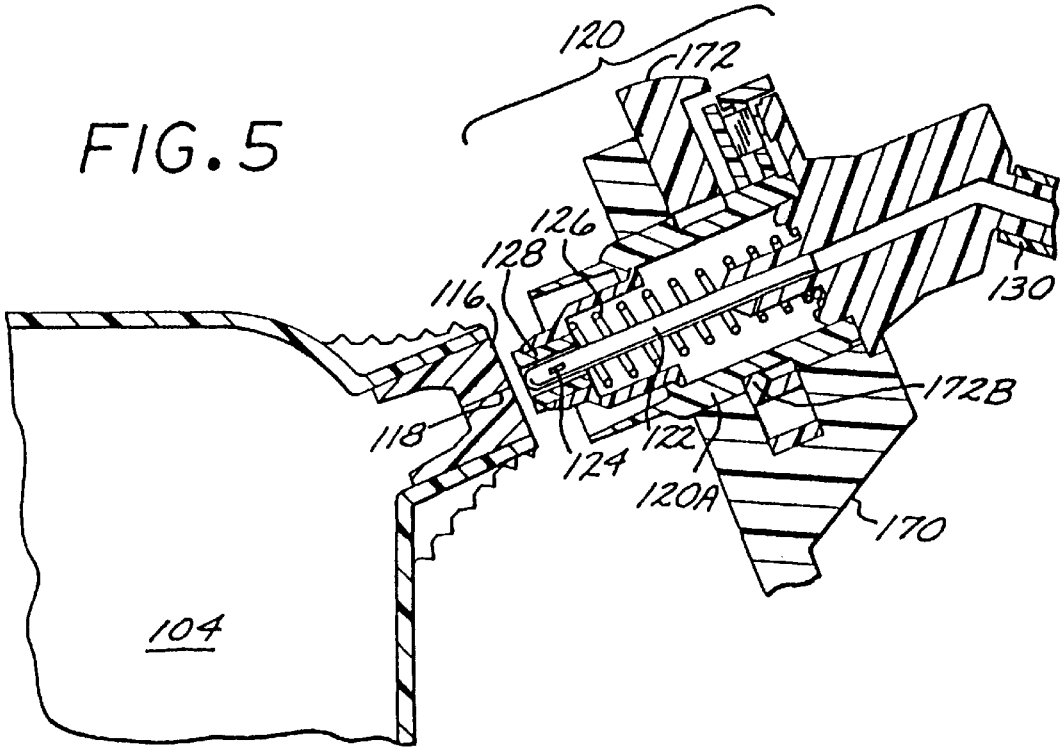
FIG. 5 is a cross-sectional view taken along line 5—5 of FIG. 4, showing the valve structure in a disengaged position relative to a refill port on the print cartridge.
Figure 9:
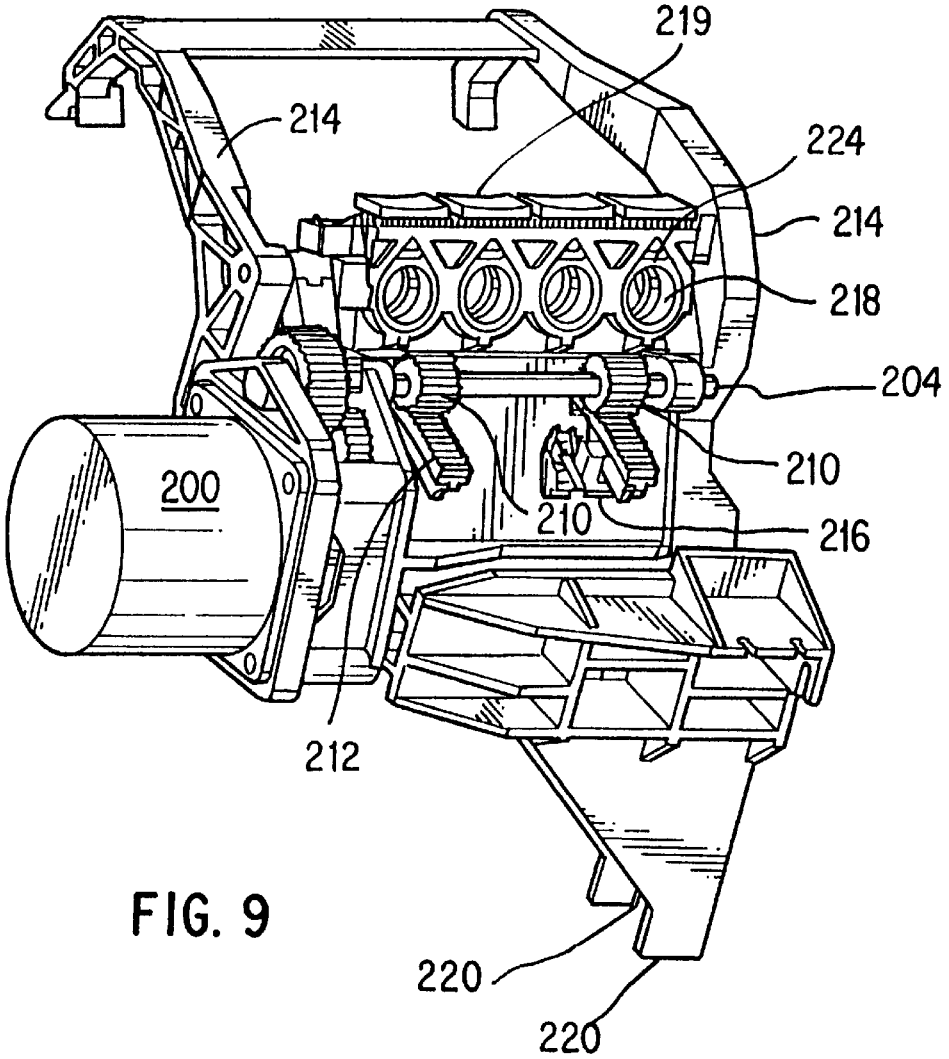
FIG. 9 is an enlarged view showing the mechanism for moving the valve structure, without any valves mounted thereon.

FIGS. 5–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a needle 122 to an off-carriage ink reservoir such as one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 5. When the structure 120 is forced against the septum 116, the collar is pressed up the length of the needle, allowing the needle tip to slide into the port opening 118, as shown in FIG. 6. In this position, ink can flow through the needle openings 124 between the reservoir 104 and the tube 130. Thus, with the cartridge 100 connected to an off-carriage reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 4–8 illustrate a locking structure 172 for releasably locking the valve 120 into the refill arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
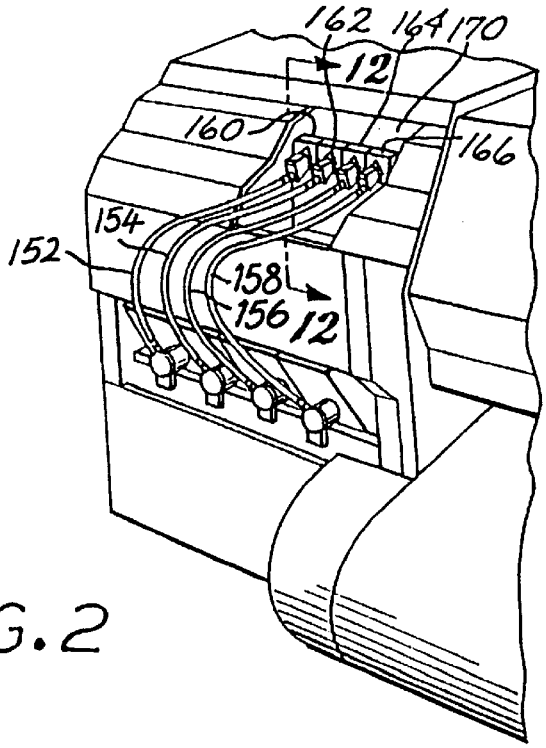
FIG. 2 is an enlarged view of a portion of the system of FIG. 1, showing the refill station.

In the exemplary system of FIG. 1, the refill platform 170 is in the left housing cover 56 of the printer 50 as shown in FIG. 2. The four off-carriage ink reservoirs 80–86 are supported on the platform 170. Short flexible tubes 150, 152, 154 and 156 connect between ports 80A–86A of corresponding reservoirs 80–86 and needle valve structures 160, 162, 164 and 166 supported at the refill platform housing 170. These needle valve structures each correspond to the valve structure 120 of FIGS. 4–8.

The refill platform 170 is an elevator that holds the four reservoirs and can be moved up and down.

Figure 13:
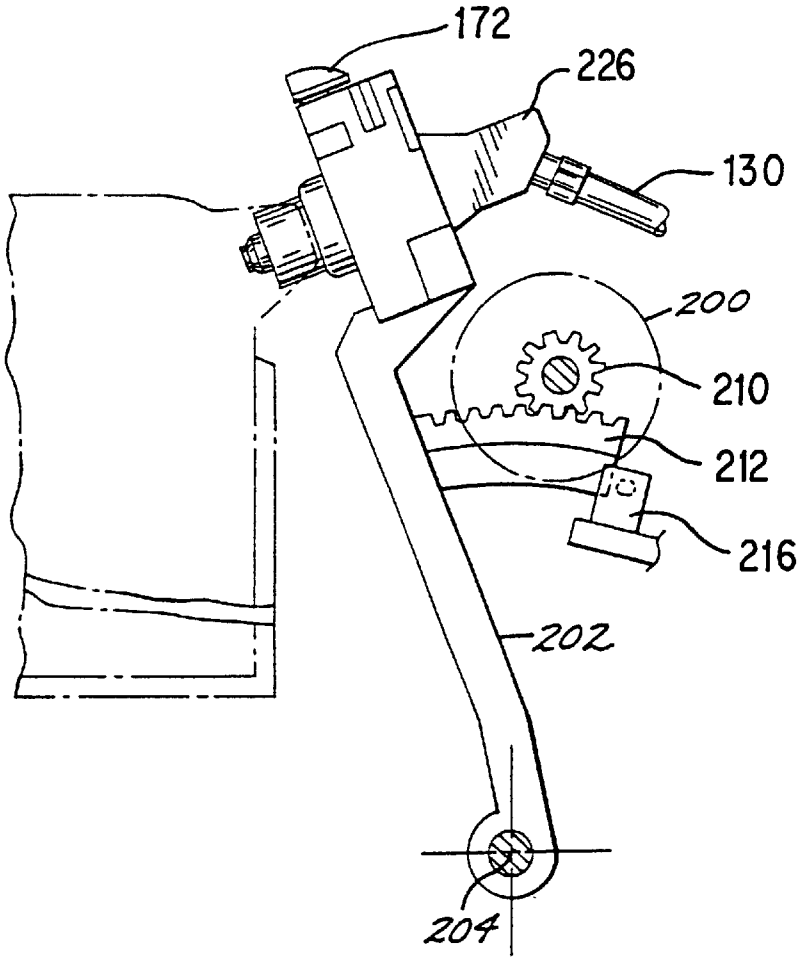
FIG. 13 is a detailed side view showing the mechanism for moving the valve structure in engaged position with a print cartridge.
Figure 12:
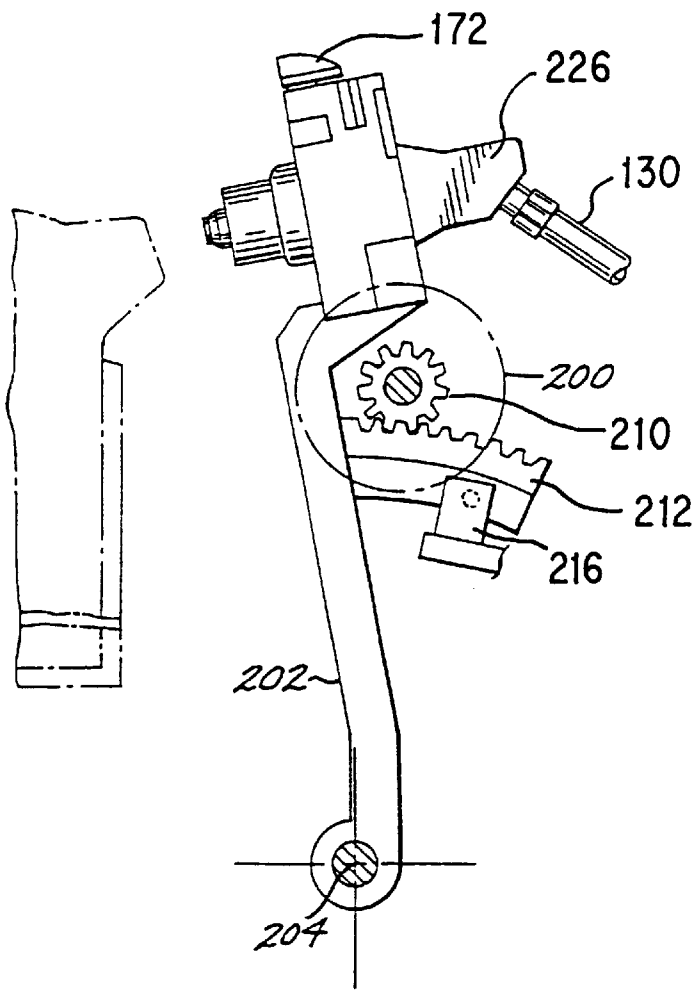
FIG. 12 is a detailed side view showing the mechanism for moving the valve structure in disengaged position with a print cartridge.

To perform a refill the carriage assembly 60 is moved to the refill station where the four off-carriage reservoirs 80–86 are connected to the corresponding print cartridges 70–76 via the needle valve structures 160–166. The connect ion of the reservoirs is accomplished by turning a stepper motor 200 that advances a lever 202 on which the valve structures and refill platform 170 are mounted, as shown in FIGS. 3 and 12–13. A system suitable for moving the valves into and out of engagement with the refill ports is more fully described in co-pending application Ser. No. 08/805,861, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduce d into the print cartridge, the back pressure decreases to a point where the print cartridge can no longer pull additional ink from the cartridge and the refill stops. The pressure at which the flow of ink stops is governed by the distance offsetting the print cartridge and the off-carriage reservoir. The farther below the print cartridge the reservoir is located, the greater the final pressure in the print cartridge and the lower the resulting volume of ink in the print cartridge internal reservoir.

Figure 16:
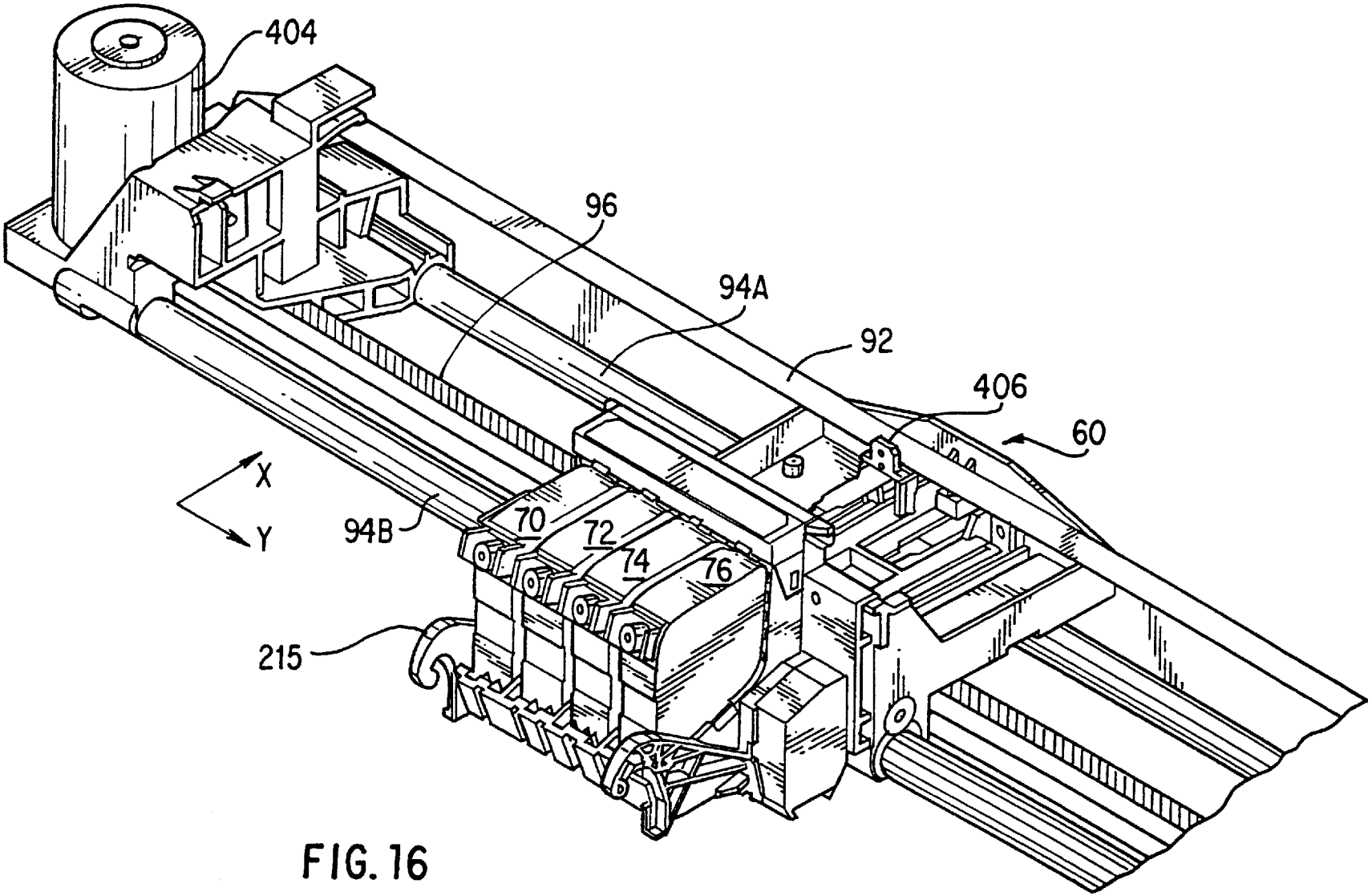
FIG. 16 is an isometric view of a carriage moving across a print zone.
Figure 17:
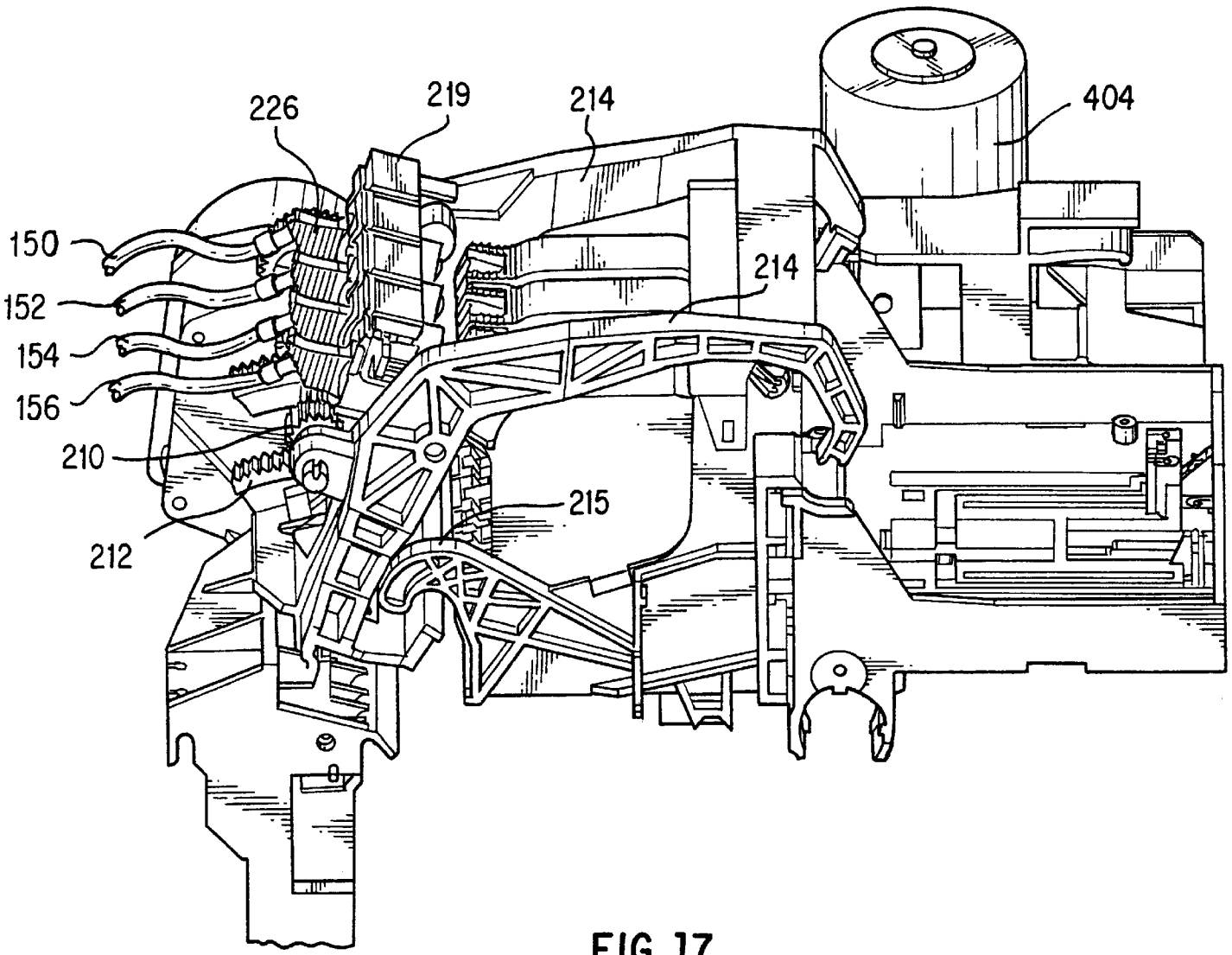
FIG. 17 shows the carriage of FIG. 16 in position at the refill station, with the valve structure in disengaged position.

As best shown in FIG. 16, the present invention does not require the specifications of the carriage to be redesigned due to the drag and interference that results from typical off-carriage ink systems where ink supply tubes remain constantly connected with the cartridges on the carriage during a printing operation. In contrast, the carriage shown in the drawings can move back and forth across the print zone without any supply tube connection whatsoever. Moreover, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described. Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 (FIG. 10 mates with a matching orientation slot 224 FIG. 9 by easy manual manipulation through a valve handle 226.

Figure 14A:
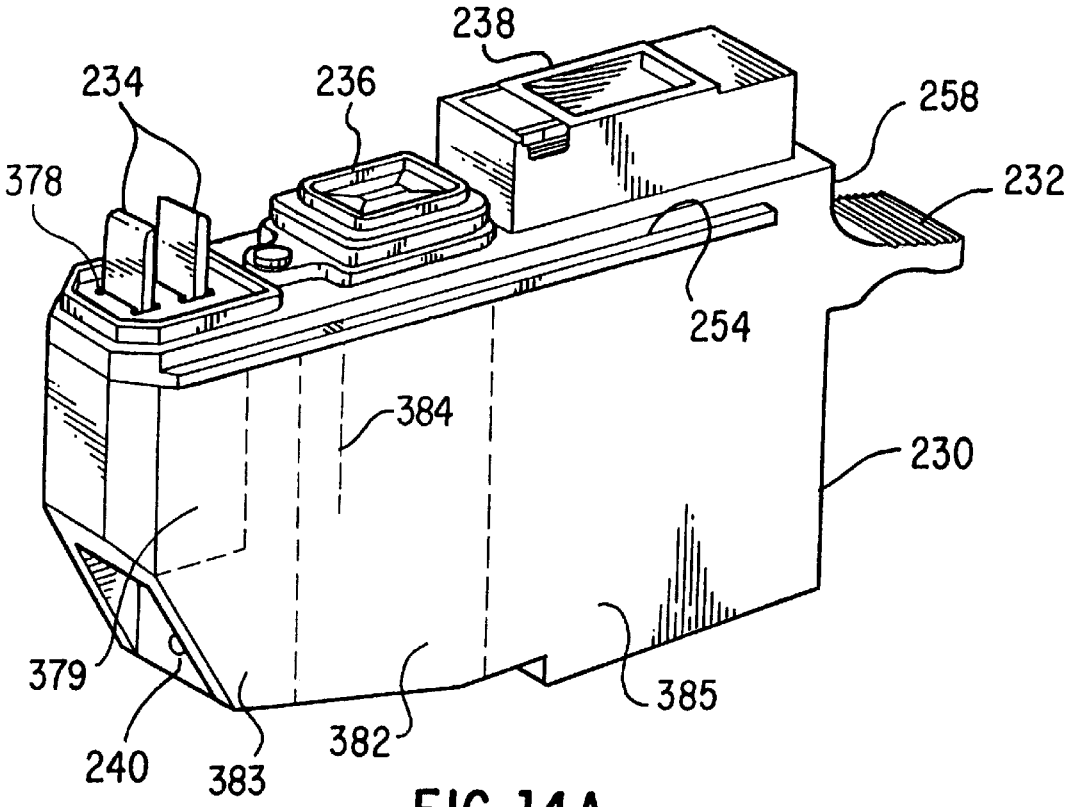
FIGS. 14A and 14B show an isometric and a side view, respectively, of a service station module incorporating the present invention.
Figure 14B:
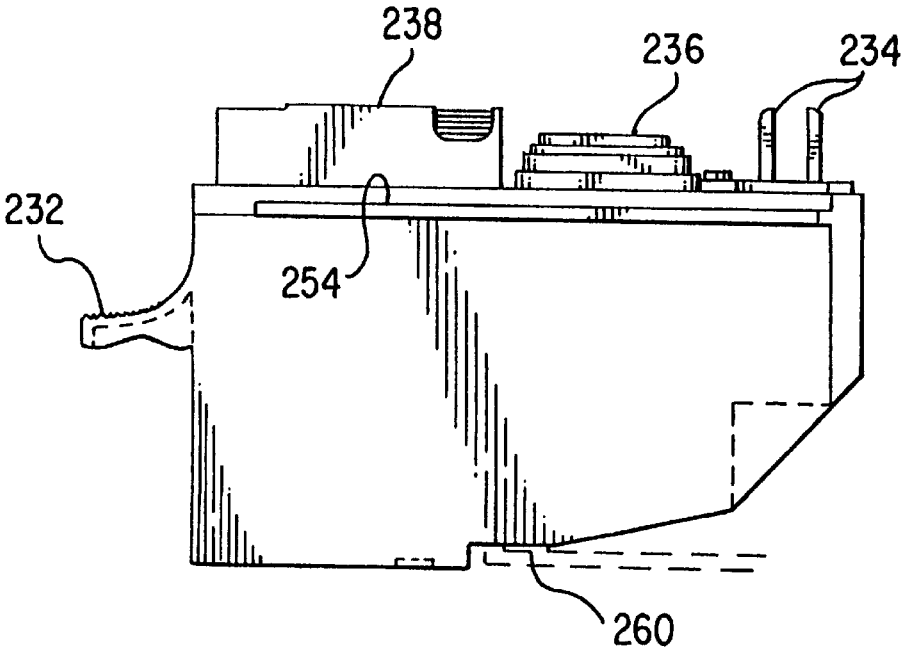
Figure 15:
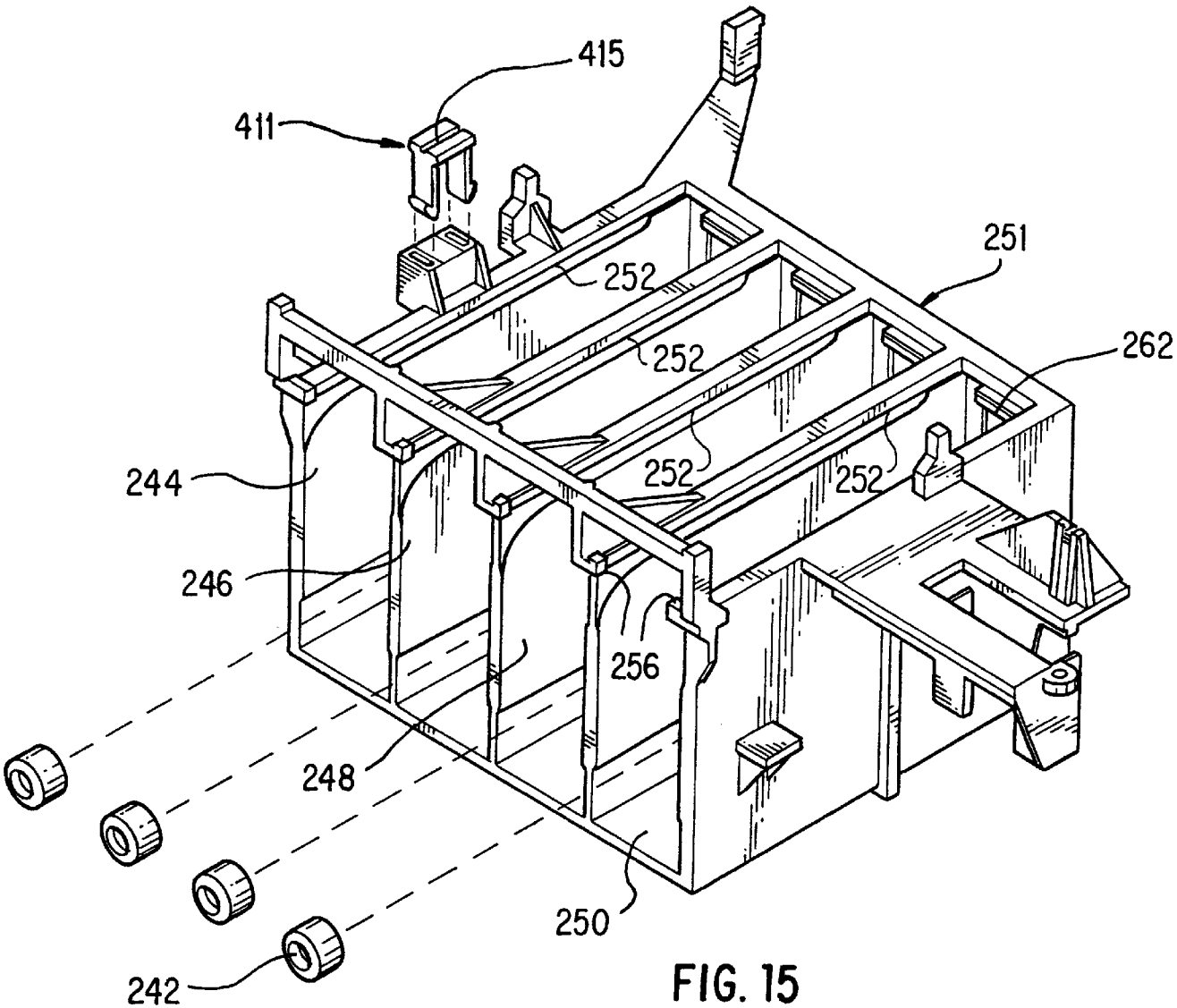
FIG. 15 is an isometric view of a carriage for removably mounting the service station module of FIGS. 14A–14B.

A unique narrow replaceable service station module 230 for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 248, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring arm 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
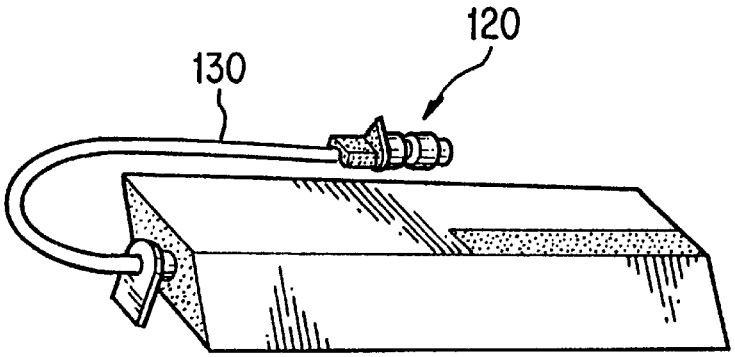
FIG. 10 shows an off-carriage ink supply module incorporating the present invention.
Figure 11:
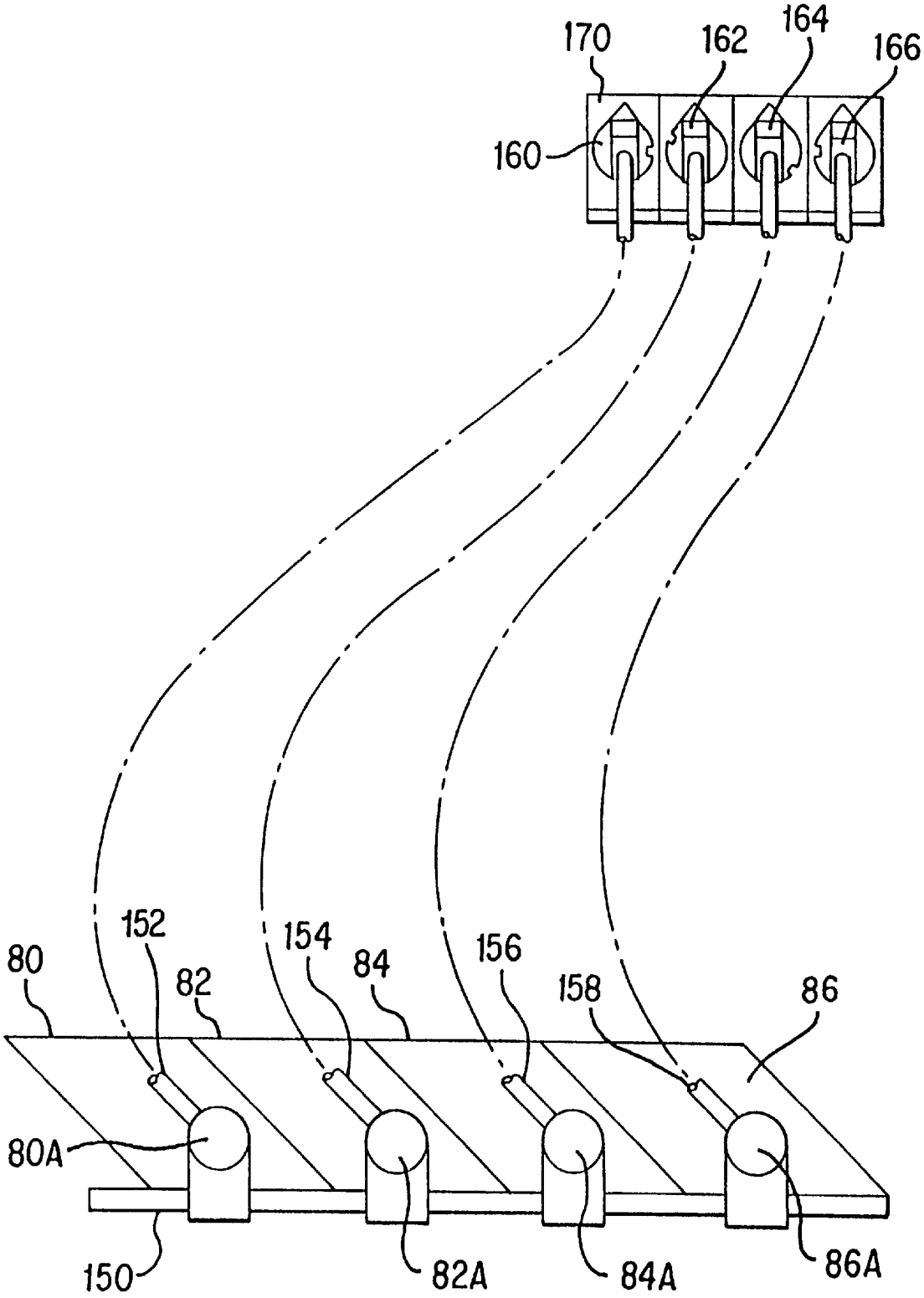
FIG. 11 is a schematic representation showing a plurality of off-carriage ink supply modules connected to the valve structure.

FIG. 10 shows the basic exterior structure of an ink supply module before installation, and FIG. 11 shows how four such modules are grouped together on a refill platform on the printer with their valves manually installed on the valve bracket.

Figure 18A:
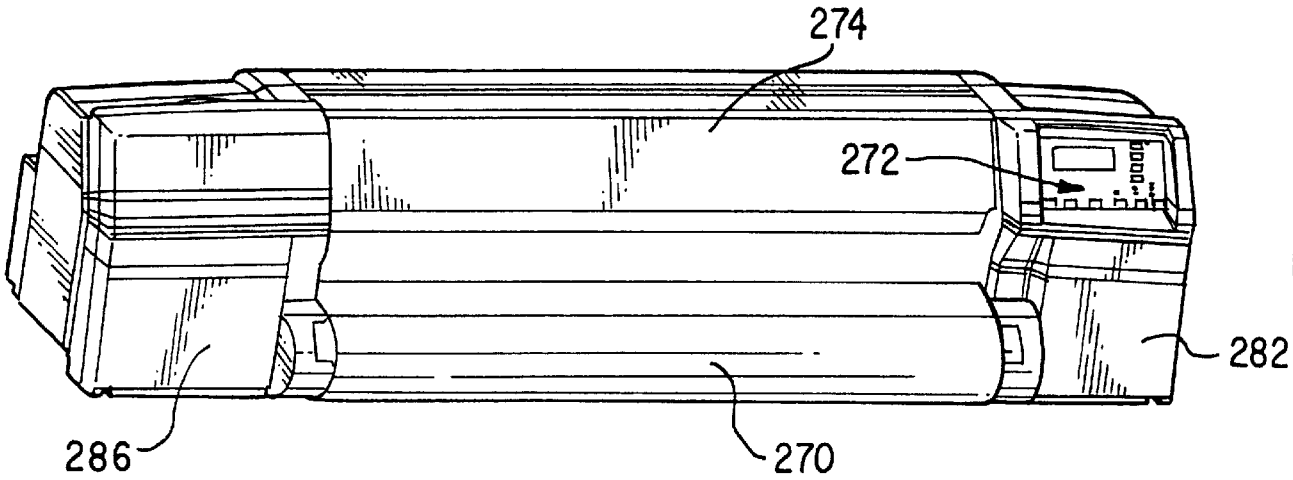
FIGS. 18A and 18B show the printer with the refill station and service station doors in closed and open positions, respectively.
Figure 18B:
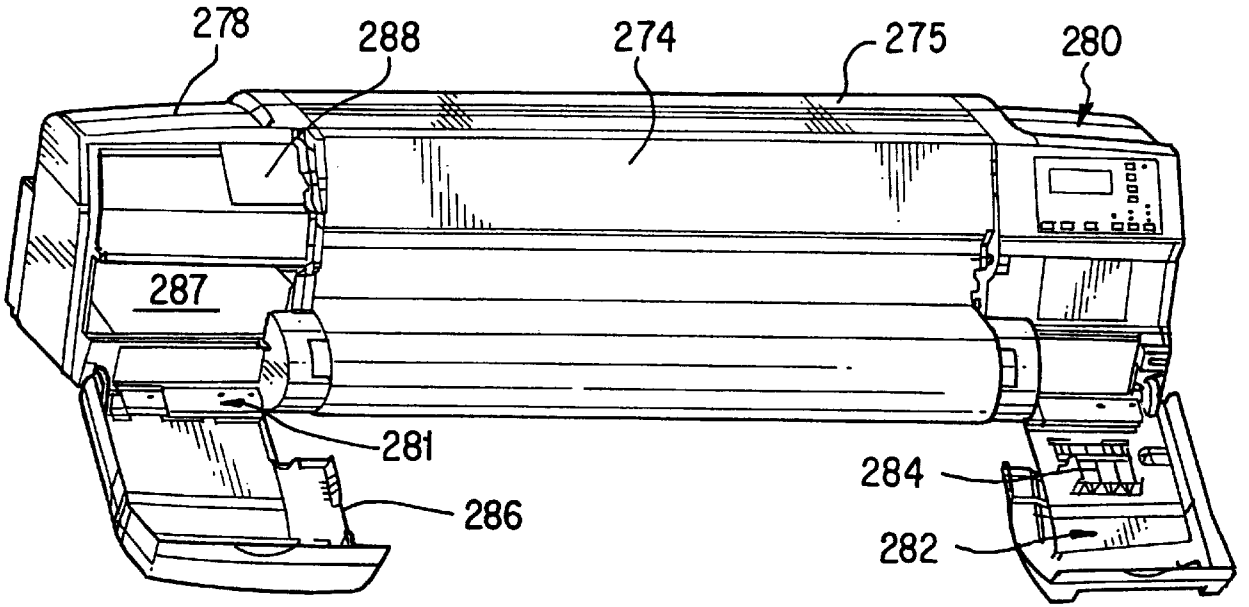
Figure 19:
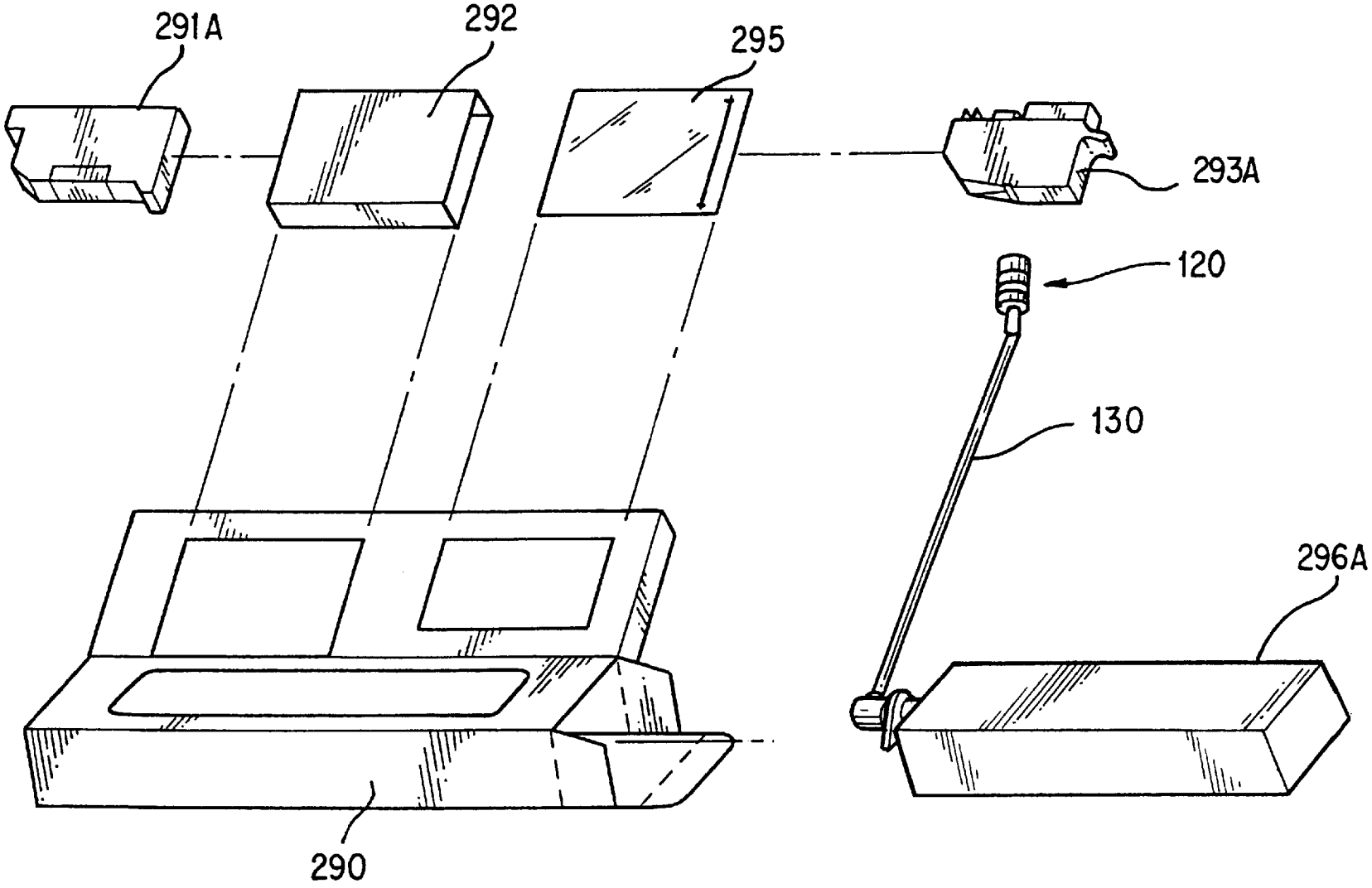
FIG. 19 is an exploded schematic view showing the integrated ink delivery system component of the invention (print cartridge, ink supply module and service station module) incorporated into a single package.
Figure 20:
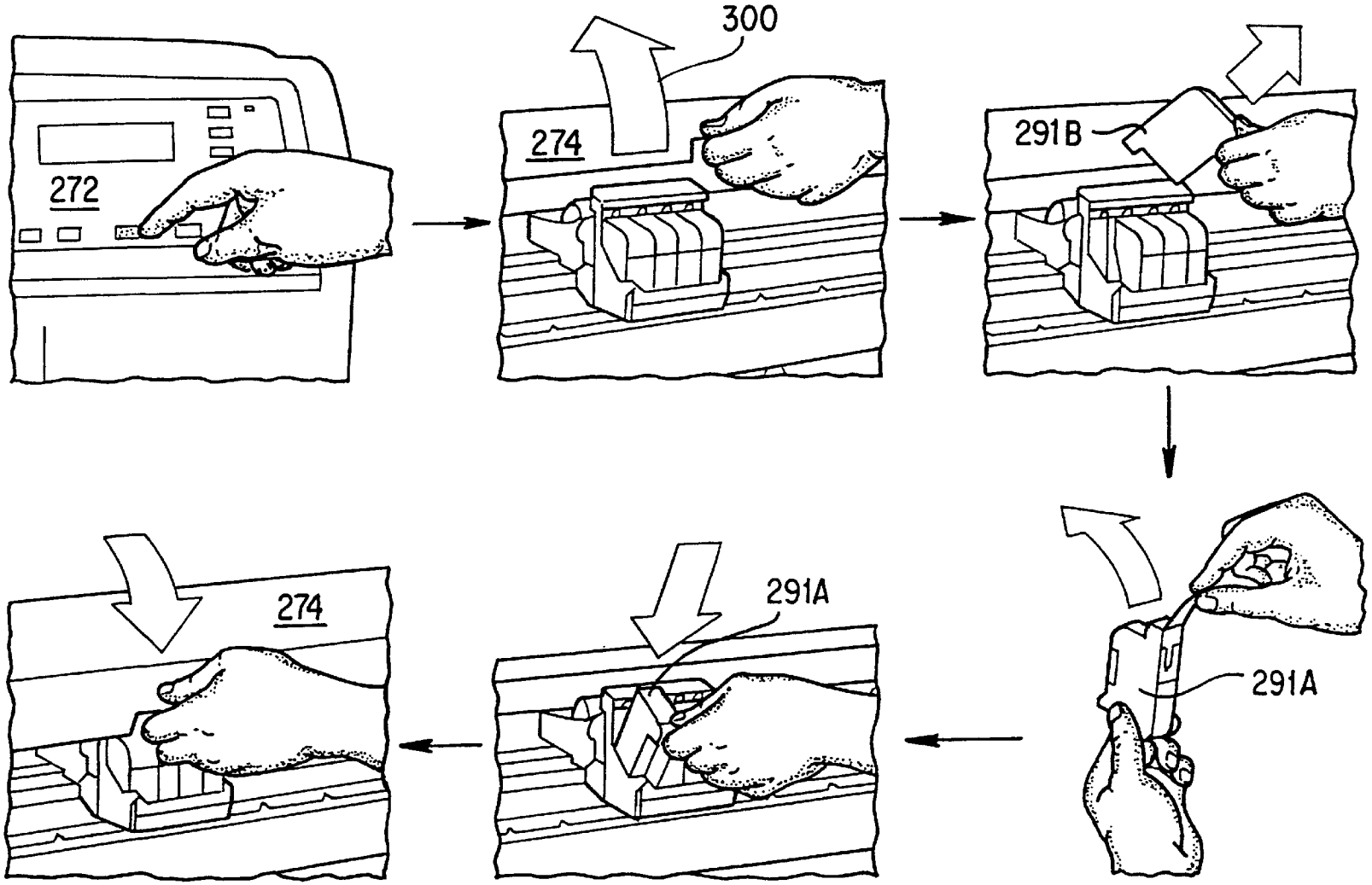
FIG. 20 shows six exemplary steps for replacing the print cartridge of the present invention.
Figure 21:
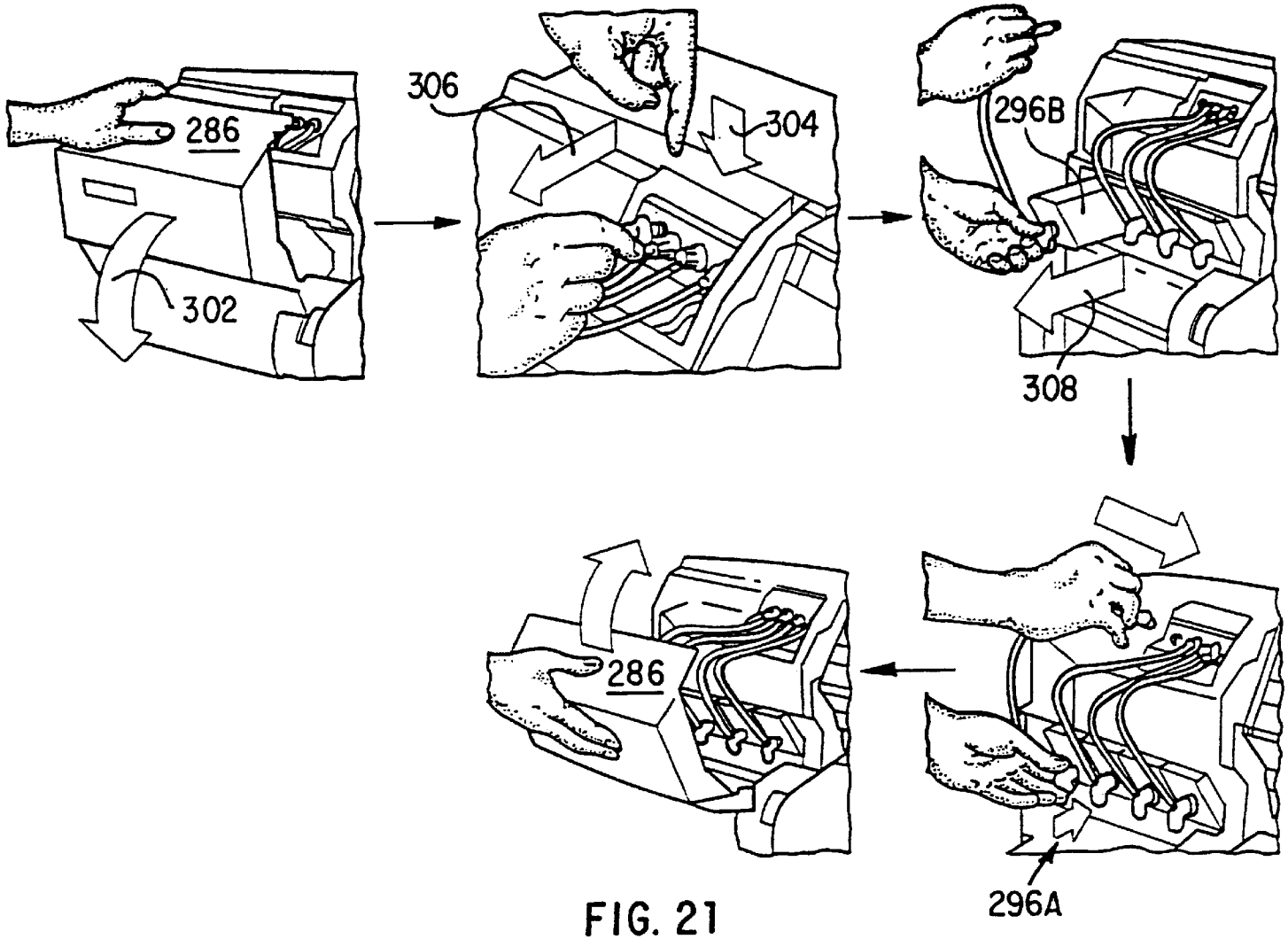
FIG. 21 shows five exemplary steps for replacing the ink supply module of the present invention.
Figure 22:
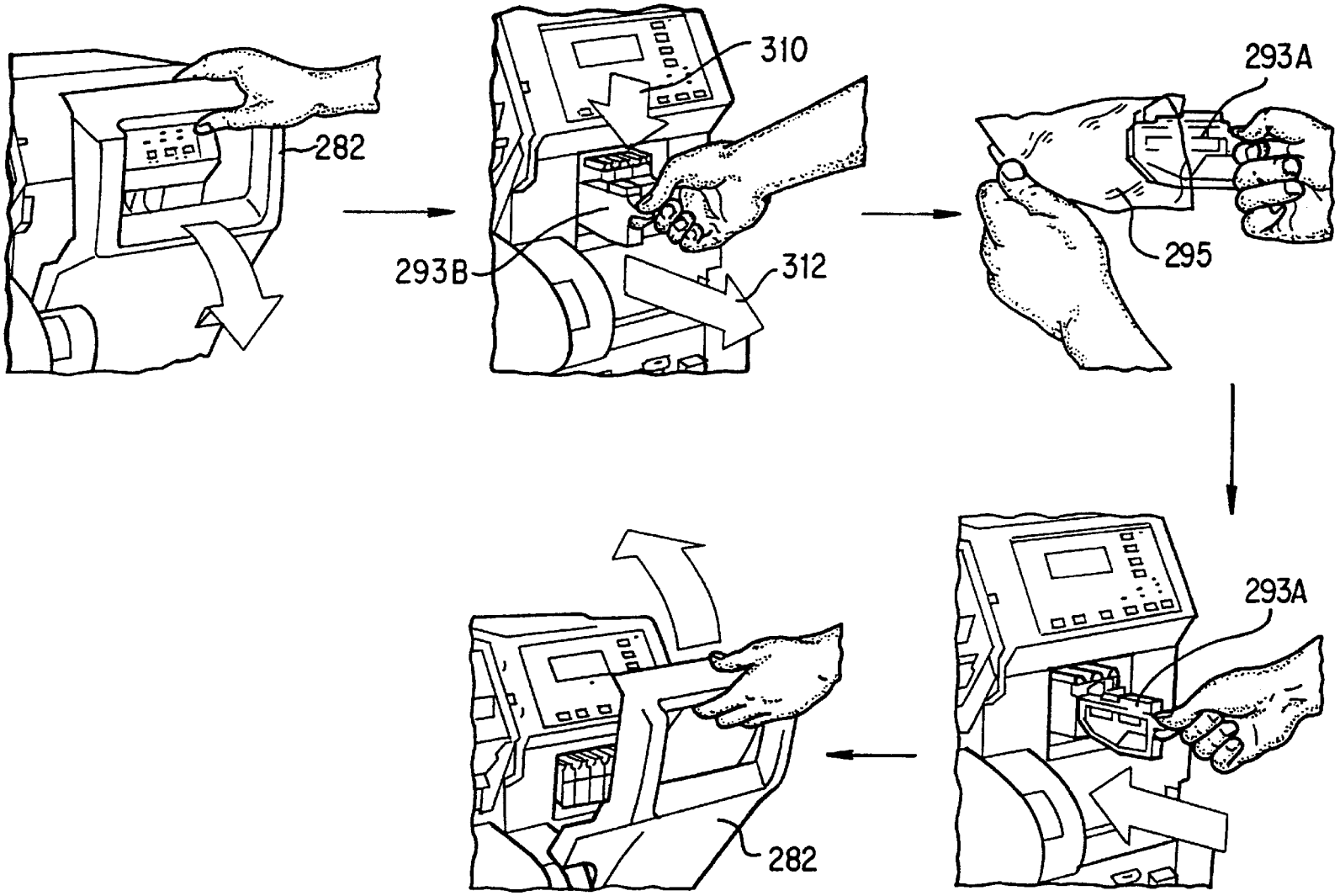
FIG. 22 shows five exemplary steps for replacing the service station module of the present invention.

FIGS. 18A and 18B illustrate the accessability required for replacement of the three basic components parts of the IDS. The front of the printer unit typically includes a roll feed unit 270, a control panel 272 and a print zone access door 274 adjacent an elongated frame member 275. The service station is located at the right end of the carriage scan axis, and a refill station 278 at the opposite end. Simple friction latches such as indicated at 280 are provided to assure proper closure of doors which a mounted on pivot hinges such as 281. A pusher plate 284 contacts and helps to position any incompletely mounted service station modules upon closure of a service station door 282. A similar door 286 closes off the refill station during normal operation of the printer. The refill station includes space 287 for an ink supply platform, and an access hole 288 from the platform to carriage-mounted printheads.

An installation procedure will now be described in conjunction with FIGS. 19–22. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG. 20, an old print cartridge 291B is easily removed and replaced with a new one. As shown in the self-explanatory sequence of drawings of FIG. 21, a depleted ink supply module 296B is removed without difficulty by first opening the ink door as shown by arrow 302, then pushing down on the lock button as shown by arrow 304 and at the same time pulling out the valve as shown by arrow 306. The depleted ink module 296B can then be replaced with a new ink supply module 296A. Finally as shown in the self-explanatory sequence of drawings of FIG. 22, after the access door is opened a user can push down on the handle in the direction shown by arrow 310 thereby dislodging an old service station module 293B, and then pull it out all the way as indicated by arrow 312, followed by installation of a new service station module 293A.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can be replaced for a particularly color of ink by a user, without the need of special tools and without the need of calling a specialized service person.

Figure 23:
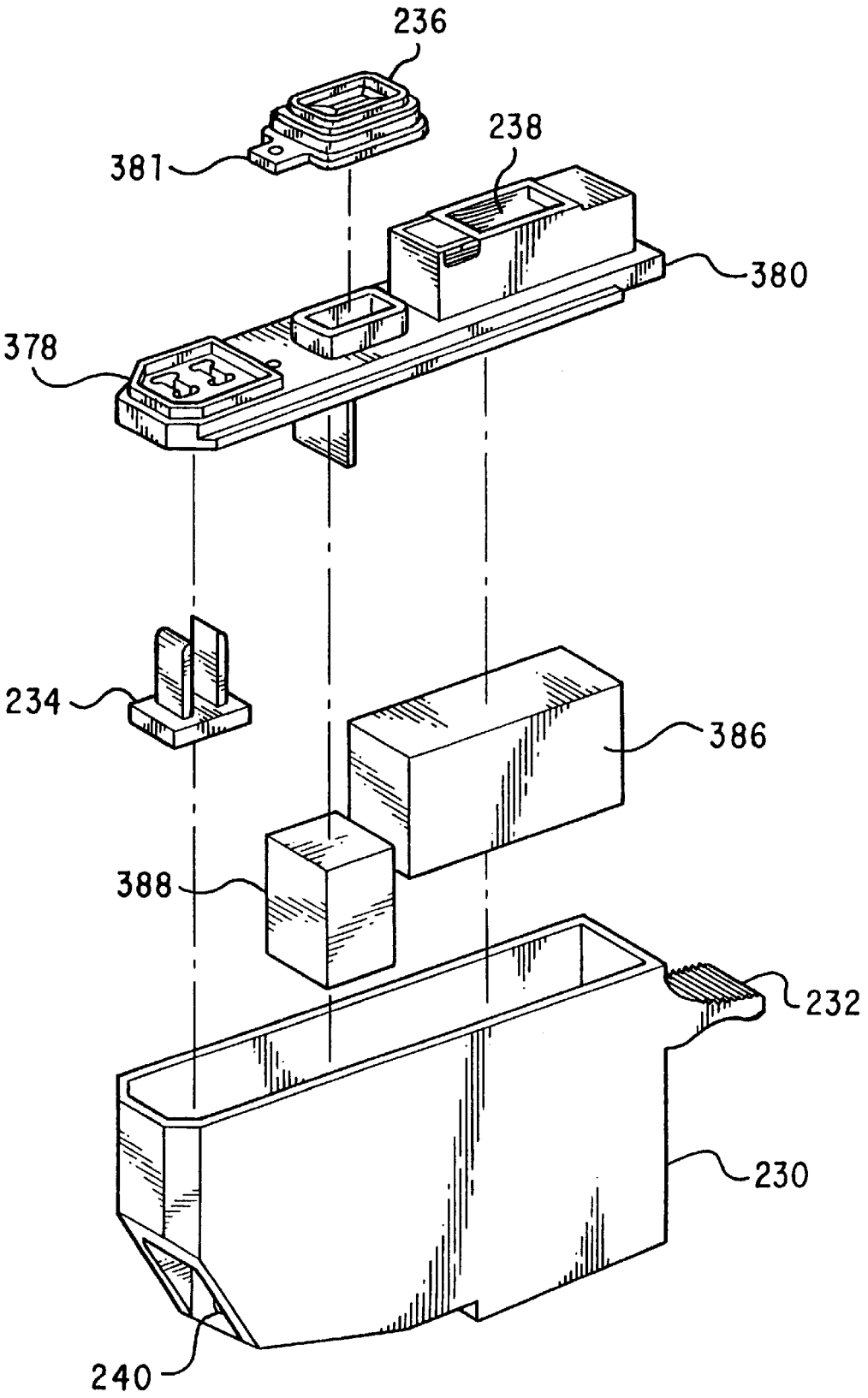
FIG. 23 is an exploded isometric view of the service station module of FIGS. 14A–14B.

Additional details of the service station module 230 are shown in FIG. 23 in conjunction with FIGS. 14A–14B. A unitary body portion defines various internal chambers and passages as well as providing a support for a top plate 380 which extends all the way across a top opening in the body portion. The spittoon 238 is in a raised position at one end of the top plate. The cap 236 is positioned and secured on the top plate with the help of a mounting tab 381, and both wipers 234 are incorporated in a single unitary part also mounted on the top plate. A drain 378 next to the wipers feeds ink from the wipers into a waste chamber 379 located in the body portion.

The primer port 240 connects through passages in the body portion to the cap. A main ink collection chamber 382 (FIG. 14) is directly under the cap and is separated from a secondary chamber 383 by a baffle 384 extending down from the top plate. In order to help prevent undue ink buildup, a larger absorbent foam block 386 (FIG. 23) is employed in the bottom of a spittoon collection chamber 385 and a similar smaller absorbent foam block 388 is placed in the bottom of the chamber 382.

Figure 24:
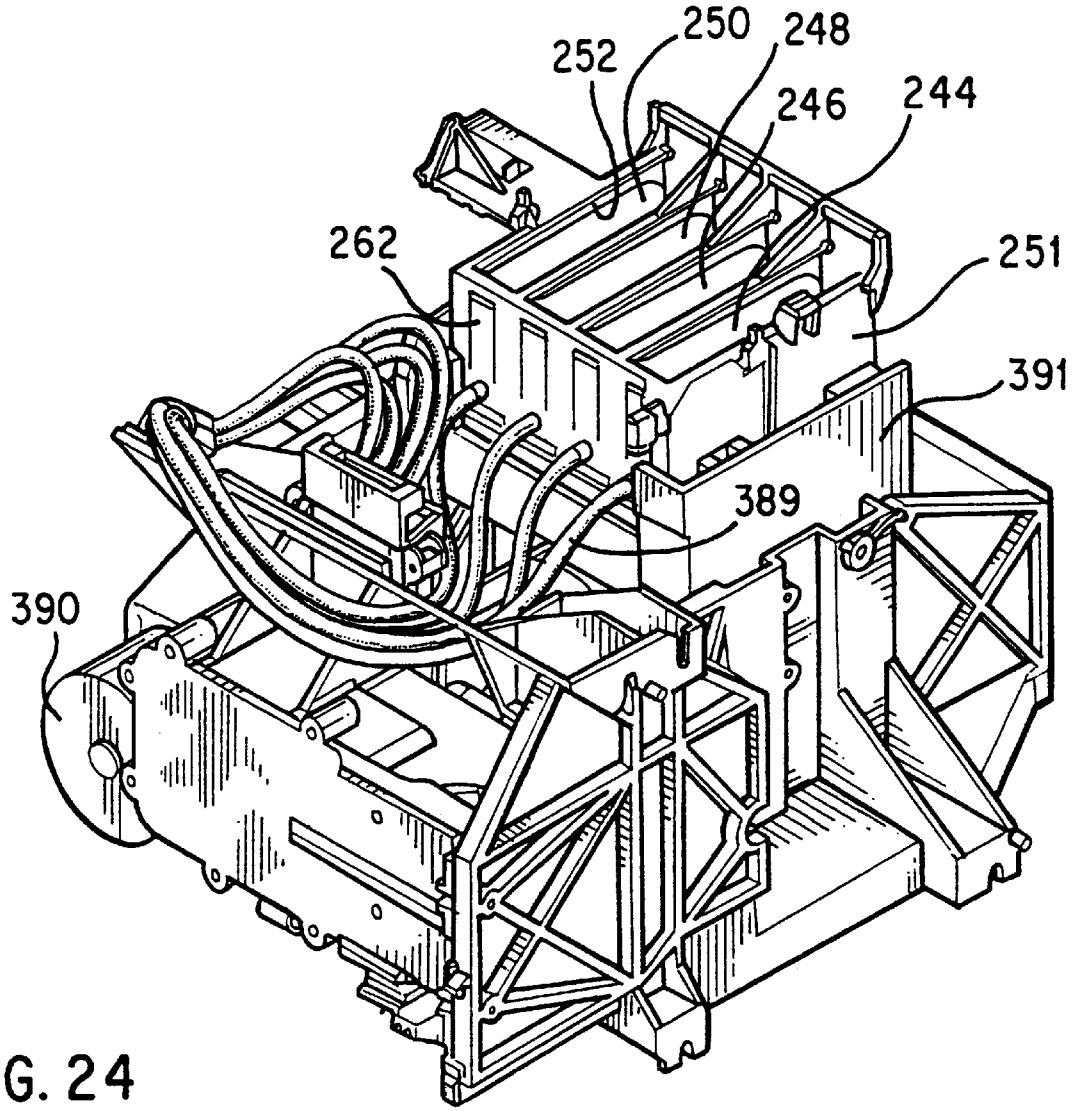
FIG. 24 is an isometric view looking down at the back of a service station unit with a service station carriage installed thereon for utilizing the service station module of FIG. 23.
Figure 25:
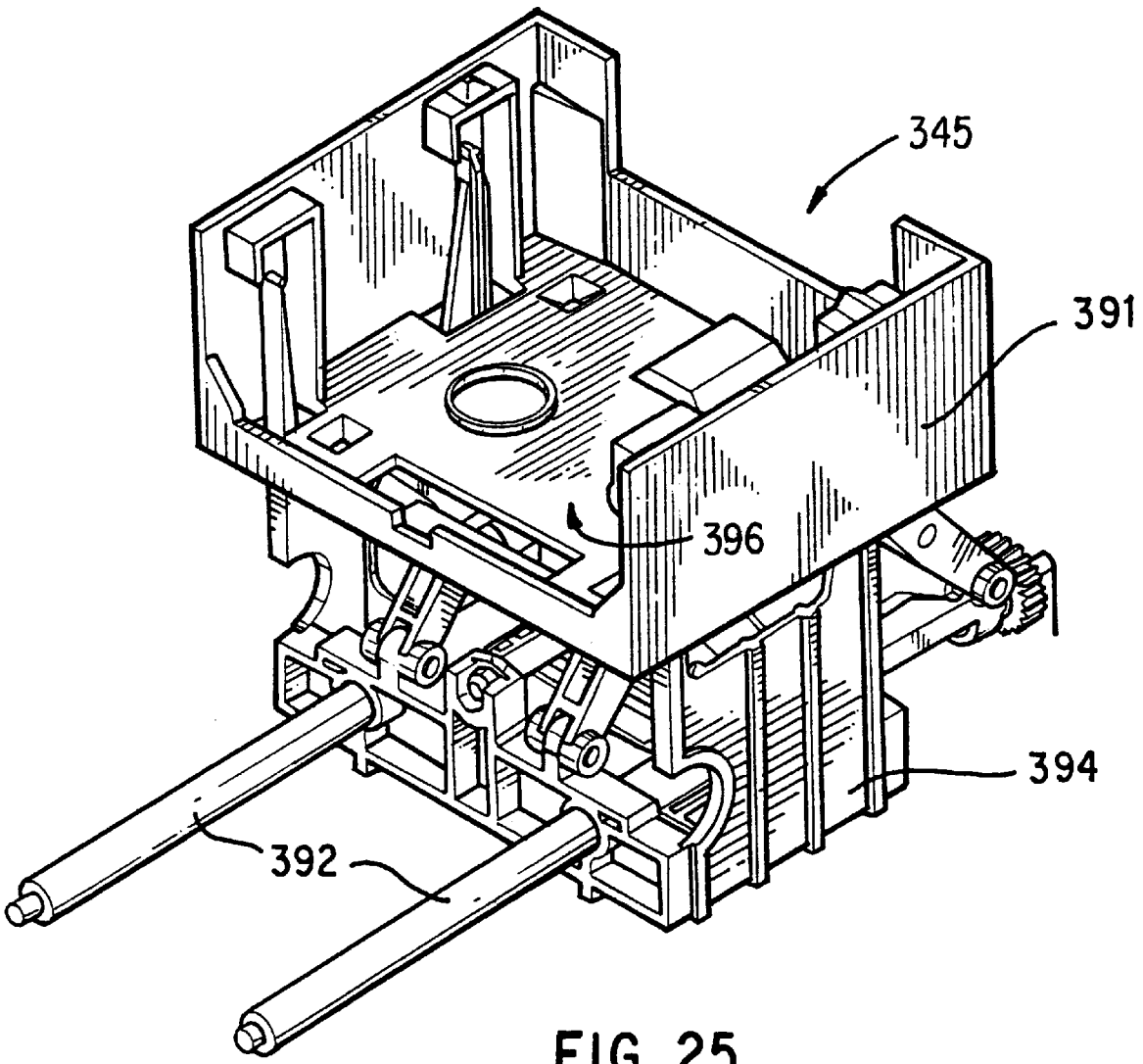
FIG. 25 is an isometric view looking down at a front portion of the service station unit of FIG. 24, without any carriage installed.

Additional details of the service station mechanism on the printer are shown in FIGS. 24–25. The service station carriage 251 has primer tubes 389 attached from the rear to the respective primer ports 240. A motor 390 is provided to move a platform 391 along slide rods 392 as part of various servicing operations as well as to position the carriage for installation or removal of individual modules by a user. The entire service station mechanism is supported by a chassis 394, and the platform includes a rear access 95 for the primer tubes 389 as well as a front access 396 to facilitate the aforementioned installation or removal of individual modules from the service station carriage.

It is to be understood that certain features of the service station module and the service station carriage are optional and are not required in order to obtain the benefits of the invention. For example, the foam inserts are helpful but not required in order in the ink collection chambers inside of the service station module. Similarly, while some form of restraint is desirable to assure secure positioning of the module in the carriage, it is not necessary to have positive biasing forces in all of the X, Y and Z axis directions. In a currently preferred form, only a biasing spring in the Z axis direction is to be employed in a proposed commercial embodiment of the invention, thus relying on a somewhat snug mechanical fit in the other axis directions. Also, such spring need not be a plastic extension of the carriage as presently used in a preferred embodiment, but could be a separate spring of different material. And other holding techniques could also be employed rather than a spring in order to stabilize the service station component sufficiently to perform its various functions relating to the cleaning, maintenance, enhancement and protection of the printhead.

Thus, once the service station modules are securely positioned in the service station carriage, all of the various important servicing functions (wiping, capping, priming, spitting, or selected sub-groups thereof) required for reliable operation of an inkjet printhead can be done in conjunction with a single module or cleaner which is dedicated solely to a single printhead and which can be removed and replaced at the same time that the associated printhead is removed. Thus the coordination of expected life of the service station module, ink supply module and printhead is an important feature of the invention. When a different ink supply such as UV ink for outdoor usage is required, an entire ink delivery system (including ink and ink-related components) can be easily replaced.

Figure 26:
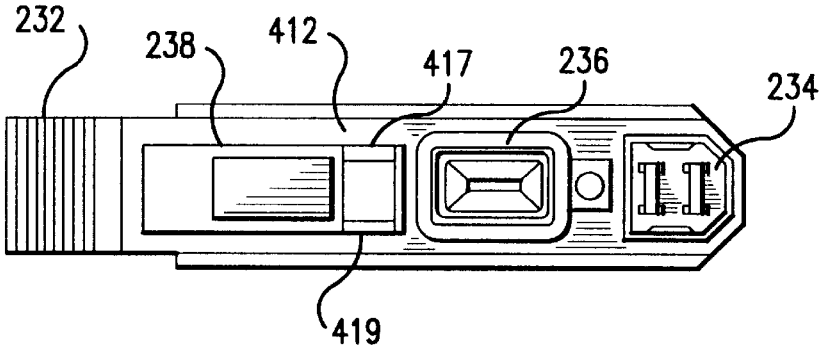
FIG. 26 is a top plan view of the service station module.
Figure 27:
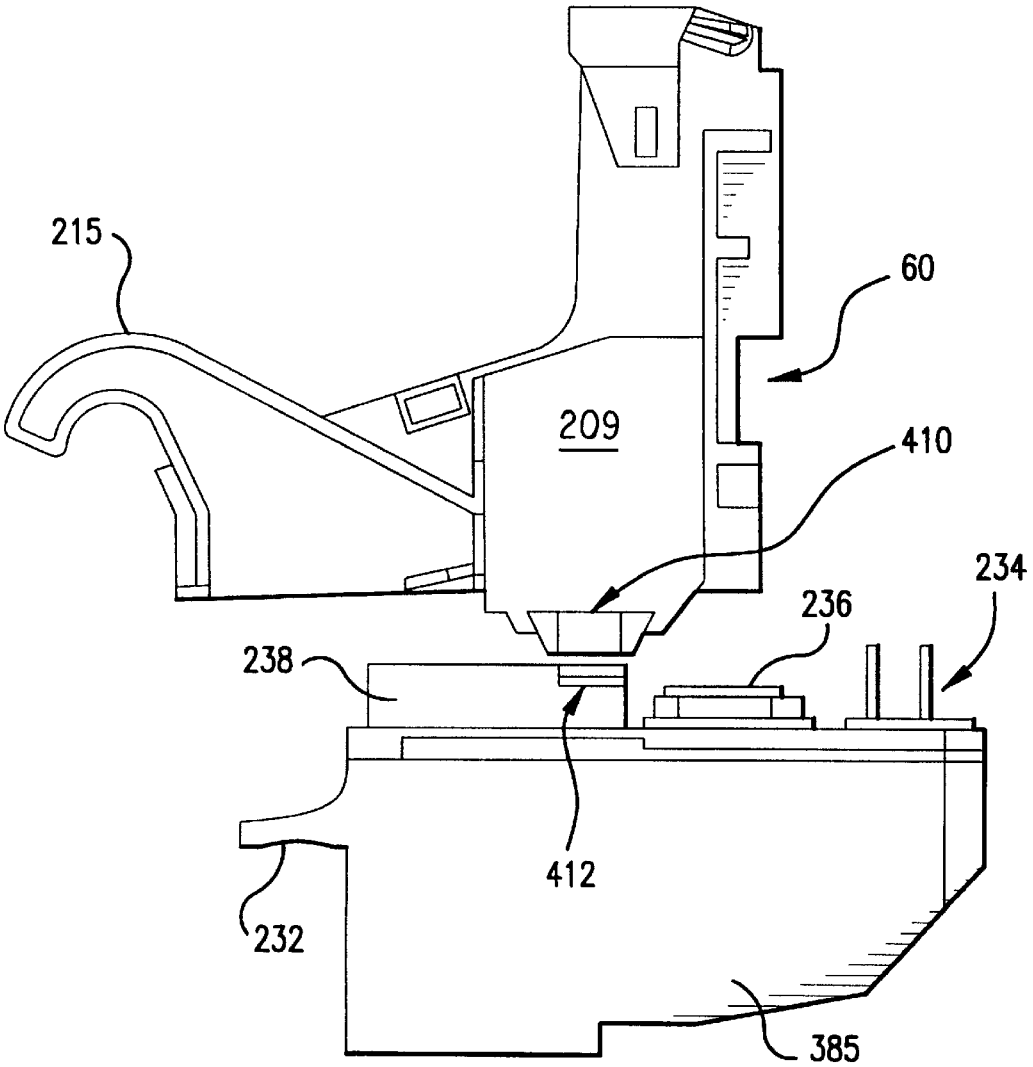
FIG. 27 is a partially schematic end view from the right side of the printer showing a carriage aligned for optical reading of encoded information on a service station module.
Figure 28:
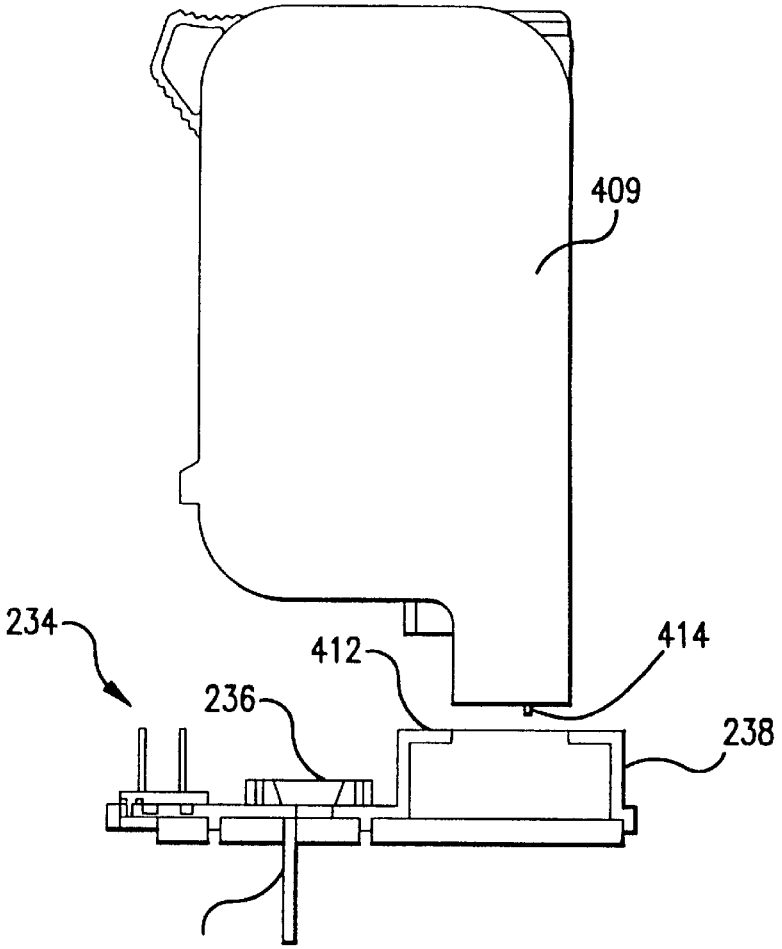
FIG. 28 is a partially schematic end view from the left side of the printer showing a carriage aligned for nozzle spitting into a spittoon on the service station module.
Figure 29:
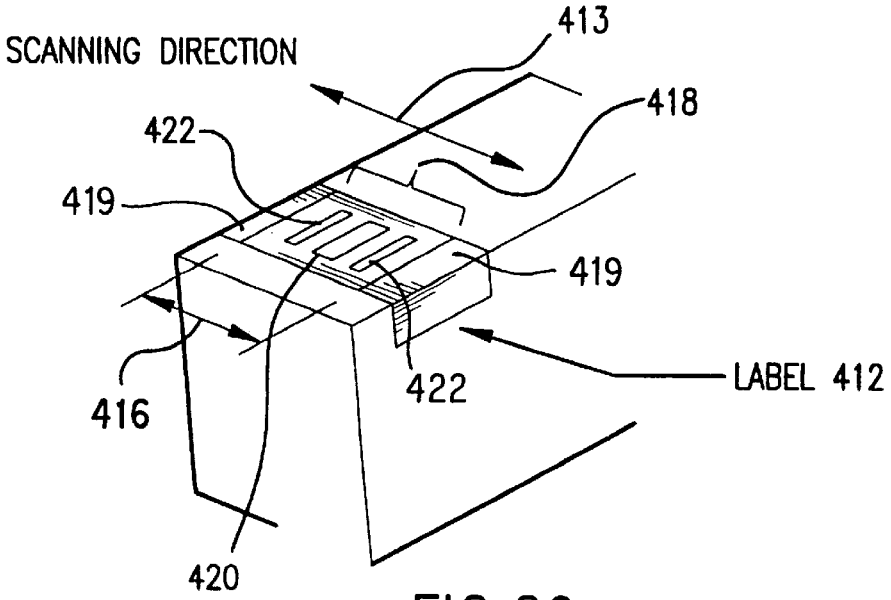
FIG. 29 is an enlarged schematic representation of label format used for encoding information on the service station module.

Additional details of the service station module are shown in FIGS. 26–29. A scan path of carriage leads on the right side of the printer to a service station where the various functional components of the service station as shown in FIG. 26 can interact with the printhead. The motor of the service station mechanism can move the service station carriage and its service station modules back an forth in order to align the appropriate component (e.g., wipers, or cap) with a print cartridge 209. An optical sensor 410 on the carriage is used to facilitate orientation of the service station module for its various functions. The details of the optical sensor are disclosed in commonly assigned co-pending application Ser. No 08/551,022 filed Oct. 31, 1995 entitled OPTICAL PATH OPTIMIZATION FOR LIGHT TRANSMISSION AND REFLECTION IN A CARRIAGE-MOUNTED INKJET PRINTER SENSOR, which is incorporated herein by reference.

Such orientation is measured from reference line 415 of white marker 411 on the service station carriage (see FIG. 15) by the optical sensor which passes directly over the marker while traversing in scan direction 413 (FIG. 20) (also called the y axis for large format printers/plotters). When a service station module is mounted in the service station carriage, a label 412 is directly aligned in the scan direction with the marker. This label serves to provide a space for recording and reading encoded information related to the service station functions.

The label is large enough to serve multiple functions. It can indicate the type of ink system intended for use with this particular module. Also, it can indicate "on the fly" information about the module such as the extent of use and the remaining intended life, indicated by the quantity, width and/or location of central markings 420 and additional markings 422 on the central space 418. System information can be applied at the time of manufacture or by the ink nozzles 414 at the beginning or during operation. Updated information can be applied at any appropriate time during operation by the ink nozzles. Thus the label acts as an information label or in some instances as a gauge as to the remaining useful life of the service station components or other components in an integrated ink delivery system. When certain negative information is sensed by the optical sensor, warning signals or messages can be displayed to the user, or in some instances certain operations of the service station can be temporarily de-activated to prevent damage to the printer, printhead, user or to the printout in progress.

This updated information is particularly important where an off-carriage ink system is designed to extend the useful life of a printhead. Wipers may wear out, ink waste chambers in the service station module may overflow.

The on-carriage sensor has previously been used primarily for alignment of multiple print cartridges in the carriage, but this new use of reading encoded information on the service module has opened new opportunities for improving the reliability of printers which are intended for long sessions of unattended printing. Thus, the number of marks, their relative positions, the particular area marked or left unmarked, or combinations thereof can all be used. With different color marks, a printer with sensitive optical processing can improve both the quality and quantity of the encoded information. In this regard, to increase the reliability of the label, the edges that extend downwardly on both ends are colored black to provide greater contrast for the optical sensor.

The invention contemplates using other built-in features of the service station module such as holes, differences in color, differences in height, differences in light reflectance, differences in shape, and the like for storing and conveying information.

The label on the service station can also be used for an additional purpose. The optical sensor reads the label to confirm the presence of a service station module properly installed, or alternatively, the absence thereof. A similar "installation confirmation" is provided for the reservoir valves of the off-carriage ink supplies.

In accordance with the foregoing description, the invention provides a cheap, easy to use 'normally closed' reservoir valve that also acts as a quick connect/disconnect with a valve holder within the printer. This quick connect/disconnect provides a positive feedback to the user, both tactile and audio. The attachment also has a secure, unambiguous locking mechanism that can withstand a 4 lb. force, due to refill engagement with a printhead mounted on the carriage. The interface is mechanically keyed so as to ensure correct color installation. Also it prevents accidental opening of this valve by the user, which could result in either ink on customer or air ingestion into reservoir. The valve triggers an 'installation verification' switch on the valve holder. It was preferable to use inexpensive, pcb thru-hole mounted mechanical switches, to sense that all four valves were fully installed. The switches, however, have an engagement pre-travel of only 0.25 mm.

One of the IDS consumables for the printer is the supplemental ink reservoir with a tube attached to a reservoir valve. The user must install the supplemental reservoir into a bay on the printer and then attach the valve to the refill mechanism valve holder. During operation of the printer, it is the automatic motion of the valve holder which causes a fluid connection to take place by engaging the reservoir valve to a septum on the ink printhead cartridge.

As the valve is loaded into the arm, the forward motion of the valve acts to push the locking gate down until the point at which the groove in the valve housing lines up with the gate. The gate then snaps upward into the groove, thereby locking the valve into place. For the user to remove the valve, once the consumable is at 'end of life', the gate button is pushed. The 'orientation arrow' on the valve acts to partially eject the valve from the arm. The user can then remove the valve.

This attachment method also provides a way to snap the ink delivery valve into the valve holder on the printer. It allows a simple forward motion connection, and a push button actuation to disconnect. When the button is pushed to disconnect, the valve partially ejects from the valve holder, thereby allowing a one handed operation of removal.

The 'orientation arrow' on the tube attachment piece was designed to flex or deflect at a spring force greater than the switch actuation. This allows the final installed position of the valve to be 'overtravelled', ensuring that the mechanical switch is depressed. It is possible to use inexpensive mechanical switches which operate successfully even with bad tolerances.

Figure 30:
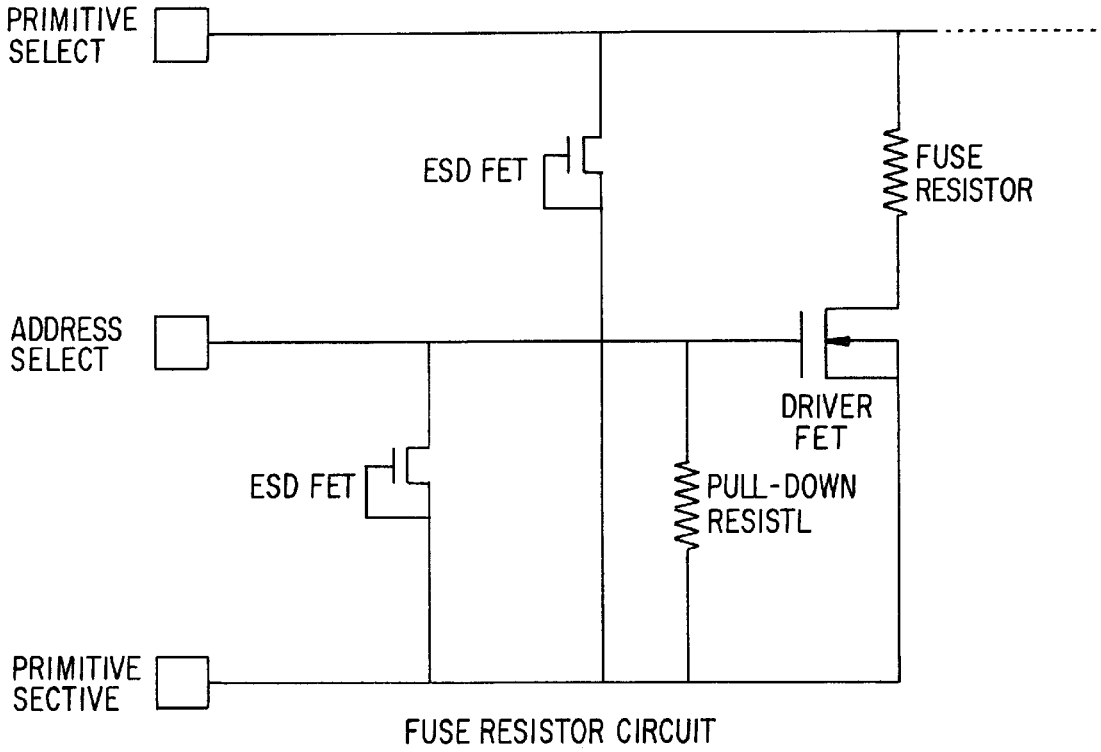
FIG. 30 is a schematic circuit diagram showing the programmable fuse circuit for identifying pens by assignment of a random ID # burned into a series of the unused firing resistors.

This invention uses pen fuses which are programmable by standard printer electronics (see FIG. 30) to provide a way to store information on a pen so that it is not lost when the pen is removed from the printer and to confirm proper installation procedures for a new pen. This may allow every pen to be marked with a unique ID when first installed into a printer. This ID may be stored on the printer's hard disk and is tied to a number of drops fired so that ink usage may be tracked. Without this, anytime a pen is changed or the product is turned off we would not be sure that the same pen was inserted and these initializations/calibrations would have to be redone and ink usage would be lost.

As compared to the small desktop printers, large format printing uses a lot more ink. Also, in the new large format imaging market, batch jobs or overnight printing are common. Users need to know the amount of ink left in their printing system so they can be assured they have enough ink for large batch jobs and so they know when to purchase another printing system. Because of the amount of ink in a large format imaging plot and because of the prevalence of batch jobs, partially used pens are temporarily removed so new pens can be inserted. It is also common for these printers to be in remote locations so users require that the printer stop if a pen has run out of ink. The media is very expensive and if the printer kept printing when one pen ran out of ink, the ink from the other pens and the media would be wasted. Testing for out of ink requires time and many drops of ink, so it is crucial that this algorithm be invoked only after the low ink warning has been reached. If the printer does not know the ink usage of a printing system, it does not know when to invoke out of ink testing.

Ink usage or number of drops fired can be stored in the printer but if that pen is removed all data is lost. External storage devices are expensive and require an additional sensor to be added to the product.

Due to the curved platen of the large format printer all of the 300 resistors are not used. This allows the unused resistors to be designed as fuses. These fuse resistors are up to 3 times smaller than normal printing resistors and will be protected from ink by being moved in from the ink channel and covered with barrier material. The Tantum-Aluminum top thin film layer will be removed over these small resistors so that the possibility of the Aluminum layer shorting to this top layer is eliminated. These fuses can be blown easily by the printer electronics with the same type of energy pulse sent to fire a normal resistor. The number of fuses will be based on how much information the printer will need to store.

When a user installs a new system (pen, ink supply and service station) the printer may send the required energy to a number of fuses that would blow open and this may be stored as this system's ID on the printers hard disk. Using drop counting the printer may determine how much ink was being used and store this in relation to the ID or blow fuses at predetermined intervals as an ink level gauge. An indicator light on the printer or a display on the computer may inform the user as to how full the ink supply was and how much more printing may be done. Thus, the user may decide whether there was enough ink left for another print job or when to buy an additional supply. If there was ink remaining, but not quite enough for a large job, the user may put in a full system then re-install the almost empty system at a later date. Having the ink level gauge encoded on the pen as well as an ID there would be no concern that this information would be lost or that the printer would not know when to invoke out of ink testing algorithms.

An expensive external sensor does not need to be added to the system. Information stays with the printhead even if it is removed from the printer. It provides the ability to monitor ink level usage and thus automatically warn the user before a large print job that will use more than the remaining ink. It also provides the ability to assure that out of ink testing algorithms are invoked only after a low ink warning has been reached.

As indicated above, the invention provides an overall multi-component installation feedback system for replacement print cartridges, valve holders and service station cassettes for an on-carriage ink delivery system replenishment.

This system provides the ability to give feedback to the user regarding the status of the ink replenishment system components installation by color. In addition, it may prevent the machine from operating in a state that may cause damage. This may include missing components, incorrectly installed components or used up components being placed into the machine.

In previous printers the user was required to install new print cartridges on a periodic basis in order to replenish the amount of ink in the printer. These machines required changing two to four cartridges for a full ink replenishment. In this system, however, we have added an off-axis ink replenishment system. This system consists of four print cartridges, four ink reservoirs and four service station cassettes; a set of three components for each of four colors. A complete installation or ink replenishment consists of changing all twelve of these components.

In previous printers with only print cartridges, we provided limited feedback to the user by the means of a flashing light. After the installation was complete, if it was incorrect the light would flash. This light represented a "check print cartridges" warning. It did not, however, give feedback as to which color cartridge to check. In this system the opportunity for error is greatly increased due to the increase in the number of components.

Using one light as feedback to the user is not longer an adequate amount of information about so many components. It is desirable to be able to give real-time feedback on each individual component and color during the installation process as well as a final check of the entire ink replenishment system with a final installation correct confirmation to the user.

In summary, the aforementioned system includes sensors for confirming the information of each of three components for each of four colors. The three components are print cartridge, ink reservoir and service station cassette.

The sensing of the print cartridges is done using the carriage electronics to know if a printhead cartridge is present. We also use the programmable pen fuses technology to know whether the inserted cartridge is new, used or used-up.

The sensing of the service station cassettes is done using the existing line sensor on the carriage to read a label on the cassette. The printer will also print on the label to supply information as to new, used or used-up.

The sensing of the reservoir is done using sensors mounted to the valve attachment arm. The valve is permanently attached to the ink reservoir and must be inserted correctly for proper installation. There are four sensors mounted on the arm, one for each color.

The user is able to know as he is completing the installation whether or not it is going correctly. He will not have to proceed to the next step until the previous is complete. This allows for less confusion and quicker learning of the process. The user also receives a final confirmation of the process as positive reinforcement. This system ensures user and product safety by not proceeding until all components are correctly installed.

As a further feedback safeguard, the printing system includes separate safety doors 274, 286, 282 protecting each of the printhead, the ink supply and the servicing module, respectively. A safety circuit is provided which renders the printing system inoperative when any one of the safety doors is not properly closed.

An added feedback feature is a visual display on the control panel of the printer indicating which type of ink system component (printhead or reservoir valve or servicing module) as well as which individual color ink component (C or Y or M or K) is not installed or needs replacement.

While a preferred embodiment of the invention has been shown and described, it will be appreciated by those skilled in the art that various modifications can be made without departing from the spirit and scope of the invention as defined by the following claims.

We claim as our invention:

1. An inkjet printing system comprising:

a scanning carriage;

at least one printhead removably mounted in said carriage;

a first sensor feedback device to determine whether said one printhead is installed in an operable position on said carriage;

at least one off-carriage ink supply to which said printhead is periodically connected for periodically providing ink to said one printhead; and a second sensor feedback device to determine whether said ink supply is installed in an operable position in said printing system;

at least one replaceable printhead servicing module positioned to engage said one printhead when said printhead is moved into a printhead servicing station; and a third sensor feedback device which includes a sensor on said carriage for reading indicia on said servicing module to confirm that said servicing module is installed in an operable position in said servicing station.

2. The printing system of claim 1, which further includes separate safety doors for providing access to each of said printhead, said ink supply and said servicing module, respectively.

3. The printing system of claim 2 which further includes a safety circuit including door position sensors and a control circuit to render the printing system inoperative when any one of said safety doors is not properly closed.

4. A method of operating an inkjet printing system which includes a scanning carriage, at least one printhead removably mounted in said carriage, at least one off-carriage ink supply station which is periodically connected to said printhead for providing ink to said one printhead, and a printhead servicing module in a printhead servicing station, said method comprising the steps of:

determining whether a printhead is installed in operable position in said carriage;

determining whether an off-carriage ink reservoir is installed in operable position in said off-carriage ink supply station;

determining whether a servicing module is positioned in operable position in said servicing station; and providing information in real time indicative of the presence or absence of each of said printhead, said ink reservoir and said servicing module in said operable positions.

5. The method of claim 4, wherein the presence or absence of a servicing module in said operable position in said servicing station is determined tactilely and the position of said printhead relative to said servicing module is determined by using an optical sensor on said carriage to scan a target on said servicing module.

6. The method of claim 5, wherein said ink reservoir includes an ink delivery valve which is installed in operable position by manually engaging a spring locking mechanism.

7. The method of claim 6, further comprising the step of rendering said printing system inoperative when any one of separate safety doors which provide access to said printhead, said ink supply station and said servicing station is not properly closed.

* * * * *